US005427891A

United States Patent [19]

Hirano et al.

[11] Patent Number: 5,427,891

[45] Date of Patent: Jun. 27, 1995

[54] METHOD FOR DEVELOPING A SILVER HALIDE PHOTOGRAPHIC MATERIAL

[75] Inventors: Masato Hirano; Nobutaka Ohki; Nobuaki Inoue; Tetsuo Yamaguchi, all of Kanagawa, Japan

[73] Assignee: Fuji Photo Film Co., Ltd., Kanagawa, Japan

[21] Appl. No.: 266,309

[22] Filed: Jun. 27, 1994

Related U.S. Application Data

[60] Continuation of Ser. No. 24,245, Mar. 1, 1993, abandoned, which is a division of Ser. No. 702,219, May 17, 1991, abandoned.

[30] Foreign Application Priority Data

May 17, 1990 [JP] Japan ..... 2-127480
Nov. 7, 1990 [JP] Japan ..... 2-302077

[51] Int. Cl.[6] ..... G03C 1/06

[52] U.S. Cl. ..... 430/264; 430/566; 430/598; 430/223; 430/438

[58] Field of Search ..... 430/264, 566, 598, 223, 430/438

[56] References Cited

U.S. PATENT DOCUMENTS

| | | | |
|---|---|---|---|
| 2,735,765 | 2/1956 | Loria et al. | 430/551 |
| 4,684,604 | 8/1987 | Harder | 430/223 |
| 5,026,634 | 6/1991 | Ono et al. | 430/223 |
| 5,032,487 | 7/1991 | Ono et al. | 430/223 |
| 5,145,765 | 9/1992 | Okamura et al. | 430/264 |

FOREIGN PATENT DOCUMENTS

| | | | |
|---|---|---|---|
| 2083542 | 3/1990 | Japan | 430/598 |
| 2090154 | 3/1990 | Japan | 430/598 |

OTHER PUBLICATIONS

Research Disclosure, Nov., 1983, Item 23510, pp. 346–352, Anonymous.

*Primary Examiner*—Thomas R. Neville
*Attorney, Agent, or Firm*—Sughrue, Mion, Zinn, Macpeak & Seas

[57] ABSTRACT

Disclosed is a silver halide photographic material comprising:

at least one silver halide emulsion layer;

a hydrazine derivative; and at least one hydroquinone derivative represented by general formula (LI) or (LII):

(LI)

(LII)

wherein

G represents hydrogen atom or an alkyl group having 1 to 17 carbon atoms;

n represents an integer of 1 to 5; and $R_1$ to $R_{10}$ each represent a hydrogen atom, an alkyl group, an aryl group, a hydroxyl group, an alkoxy group, an aryloxy group, a halogen atom, a primary, secondary or tertiary amino group, a carbonamido group, a sulfonamido group, a carbamoyl group, a sulfamoyl group, an alkylthio group, an arylthio group, an alkylsulfonyl group, an arylsulfonyl group, a carboxyl group or a sulfo group.

10 Claims, No Drawings

METHOD FOR DEVELOPING A SILVER HALIDE PHOTOGRAPHIC MATERIAL

This is a continuation of application No. 08/024,245 filed Mar. 1, 1993, now abandoned, which is a divisional of application No. 07/702,219 filed May 17, 1991, now abandoned.

FIELD OF THE INVENTION

This invention relates to a silver halide photographic material and an ultra-high contrast negative image forming method using this material. More particularly, it relates to an ultra-high contrast negative type photographic material suitable for use as a silver halide photographic material in a photomechanical process.

BACKGROUND OF THE INVENTION

Photographic materials having good original reproducibility and requiring stable processing solutions or processing solutions having simplified replenishment are in demand to cope with the diversity and complexity of photomechanical printing processes.

In particular, phototypeset letters, handwritten letters, illustrations, and dotted photographs are mounted as originals and reproduced using a line camera. Accordingly, the originals have different densities and different line widths. The demand is great for process cameras, photographic materials, and image forming methods for finishing these originals with good reproducibility., In plate making, for catalogues or large-size posters, the enlargement (spread) or reduction (choke) of halftone photographs is widely carried out. In plate making using enlarged (spread) halftone dots, screen ruling becomes rough and out-of-focus dots are photographed, in plate making using choked dots, screen ruling/inch is larger than that of the original and finer dots are photographed. Thus, an image forming method useful for these situations must have a much wider latitude than is currently available to maintain the reproducibility of halftone gradation.

A halogen lamp or a xenon lamp is used as the light source for process cameras. Generally, photographic materials are subjected to ortho-sensitization so that they will be photosensitive to these light sources. However, it has been found that ortho-sensitized photographic materials are greatly affected by the chromatic aberration of lenses and as a result, the images produced with such materials are likely to be poor. Poor images are most pronounced when a xenon lamp is used as the light source.

Known systems that attempt to cope with the demand for wide latitude requirements for photochemical printing are, methods for obtaining line drawings or halftone images having a high contrast and a high blackening density wherein the image area and non-image area are clearly distinguished from each other. This is done by processing lith type silver halide photographic materials containing silver chlorobromide (having a silver chloride content of at least 50%) with hydroquinone developing solutions containing sulfite ion at a very low effective concentration (generally not higher than 0.1 mol/l). However, since the concentration of sulfite ion in the developing solution is low in these methods, the developing solution is very sensitive to air oxidation. This was necessitated a variety of additional efforts to keep the activity of the developing solution stable. These methods, unfortunately, make the processing speed very low and unfortunately, make the working efficiency low.

In view of this, there is great demand for an image forming system that is free of the problem of unstable image formation associated with the above-described developing method (lith development system). That is, a developing method that enables development to be conducted with a processing solution having good storage stability and also gives ultra-high contrast photographic characteristics is desired.

There have been proposed systems wherein surface latent image type silver halide photographic materials containing specific hydrazine compounds are processed with developing solutions having a pH of 11.0 to 12.3, (That contains sulfite preservatives in an amount of at least 0.15 mol/l and has good storage stability) to form ultra-high contrast negative images having a $\gamma$ (gamma) greater than 10. Such systems are described in U.S. Pat. Nos. 4,166,742, 4,168,977, 4,221,857, 4,224,401, 4,243,739, 4,272,606, and 4,311,781. These novel systems are characterized in that silver iodobromide and silver chloroiodiobromide can be used, even though only silver chlorobromide having a high silver chloride content can be used in conventional ultra-high contrast image forming systems.

The above-described image systems give good halftone quality, processing stability, rapidness and original reproducibility. However, a large demand still exists for a system having improved original reproducibility to cope with the diversity of prints. That are currently copied using photomechanical printing processes.

JP-A-61-213847 (the term "JP-A" as used herein means an "unexamined published Japanese patent application") and U.S. Pat. No. 4,684,604 disclose photographic materials containing redox compounds which release a photographically useful group by oxidation. These patents attempt to widen the gradation reproduction region. However, the desired redox compounds interfere with high contrast in ultra-high contrast processing systems using hydrazine compounds.

Embodiments containing redox compounds which release a restrainer by oxidation in the systems using hydrazine compounds are disclosed in JP-A-61-156043, JP-A-61-213847 and JP-A-64-72140. However, when redox compounds which release a restrainer are used in systems for obtaining high contrast with hydrazine compounds, the $\gamma$ (gamma) value is lowered. On the other hand, when the amount of hydrazine compounds is increased, highly active hydrazine compound is used or a chemically sensitized silver halide emulsion is used, black peppers are formed.

Embodiments wherein hydroquinone derivatives are added to systems using hydrazine compounds are disclosed in JP-A-54-40629, JP-A-56-1936, JP-A-56-9743, JP-A-56-89738, JP-A-57-129436, JPA-57-129433, JP-A-57-129434, JP-A-57-129435, JP-A-61-233734, JP-A-62-247351, JP-A-63-15237, JP-A-63-103232, JP-A-01-55549, JP-A-01-147536, and JP-A-62-21143.

Embodiments using silver chlorobromide are disclosed in JP-A-53-20921, JP-A-54-37732, JP-A-60-83028, JP-A-60-112034, JP-A-62-235947, and JP-A-63-103232.

SUMMARY OF THE INVENTION

Accordingly, an object of the present invention is to provide a photographic material for plate making, that produces a high-contrast image using highly stable developing solutions.

Another object of the present invention is to provide a photographic material for plate making, that gives excellent gradation reproducibility and scarcely forms black peppers (BS).

Still another object of the present invention is to provide a silver halide photographic material which is excellent for line work and gives good image quality in terms of spread and choke.

Another object of the present invention is to provide a silver halide photographic material which does not undergo a lowering of sensitivity, of the $\gamma$ (gamma), and Dmax even when the pH of developer decreases or the concentration of bromine ion increases after large quantities of film have been processed.

Still a further object of the present invention is to provide a silver halide photographic material which has improved properties with regard to black peppers.

These and other objects are satisfied by a silver halide photographic material comprising:

at least one silver halide emulsion layer;

a hydrazine derivative; and at least one hydroquinone derivative represented by general formula (LI) or (LII):

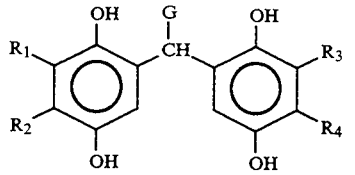

(LI)

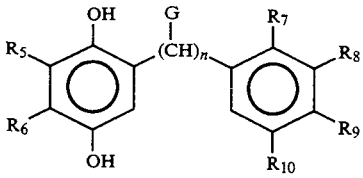

(LII)

wherein

G represents a hydrogen atom or an alkyl group having 1 to 17 carbon atoms;

n represents an integer of 1 to 5; and $R_1$ to $R_{10}$ each represent a hydrogen atom, an alkyl group, an aryl group, a hydroxyl group, an alkoxy group, an aryloxy group, a halogen atom, a primary, secondary or tertiary amino group, a carbonamido group, a sulfonamido group, a carbamoyl group, a sulfamoyl group, an alkylthio group, an arylthio group, an alkylsulfonyl group, an arylsulfonyl group, a carboxyl group or a sulfo group.

Furthermore, these objects of the invention are satisfied by a silver halide photographic material comprising a support having thereon at least one silver halide emulsion layer and at least one hydrophilic colloid layer, wherein at least one of the silver halide emulsion layer or the hydrophilic colloid layer contains a hydrazine derivative and at least one of the silver halide emulsion layer or the hydrophilic colloid layer contains at least one hydroquinone derivative represented by general formula (LI) or (LII) described above and particularly the silver halide photographic material described above wherein the at least one silver halide emulsion layer has a silver chloride content of at least 50 mol %.

DETAILED DESCRIPTION OF THE INVENTION

The hydroquinone derivatives represented by general formula (LI) or (LII) are illustrated in more detail below.

G represents a hydrogen atom or an alkyl group (preferably having 1 to 17 carbon atoms, e.g., a methyl, ethyl, propyl, isopropyl, or undecyl group); n represents an integer of 1 to 5; and $R_1$ to $R_{10}$ each represent a hydrogen atom, an alkyl group (preferably having 1 to 20 carbon atoms, e.g., a methyl, ethyl, t-butyl, t-octyl, a petandecyl group), an aryl group (preferably having 6 to 20 carbon atoms, e.g., a phenyl, or 4-methoxyphenyl group), a hydroxyl group, an alkoxy group (having 1 to 20 carbon .atoms, e.g., a methoxy, butoxy, or methoxyethoxy), an aryloxy group (preferably having 6 to 20 carbon atoms, e.g., a phenoxy, or 4-methylphenoxy), a halogen atom (e.g., Cl, Br, or F), a primary, secondary or tertiary amino group (preferably having 0 to 20 carbon atoms, e.g., a dimethylamino, or phenylamino group) a carbonamido group (preferably having 2 to 20 carbon atoms, e.g., an acetamido, benzoylamino, or hexadecaneamido group), a sulfonamido group (preferably having 1 to 20 carbon atoms, e.g., a methanesulfonamido, benzenesulfonamido, or hexadecane-sulfonamido group), a carbamoyl group (preferably having 1 to 20 carbon atoms, e.g., a methylcarbamoyl, or N,N-diphenylcarbamoyl group), a sulfamoyl group (preferably having 0 to 20 carbon atoms, e.g., a phenylsulfamoyl, or N,N-dioctylsulfamoyl group), an alkylthio group (preferably having 1 to 20 carbon atoms, e.g., a methylthio, octylthio, or hexadecylthio group), an arylthio group (having 6 to 20 carbon atoms, e.g., a phenylthio, or 4-t-octylphenylthio group), an alkylsulfonyl group (preferably having 1 to 20 carbon atoms, e.g., a methanesulfonyl, or octanesulfonyl group), an arylsulfonyl group (preferably having 6 to 20 carbon atoms, e.g., a benzenesulfonyl, or 4-dodecylbenzenesulfonyl group), a carboxyl group, or a sulfo group.

Each of the above-described groups may be substituted. Examples of substituent groups include an alkyl group, an alkoxy group, a halogen atom, a hydroxyl group, a carbonamido group, a sulfonamide group, an aryl group, an amino group, a nitro group, a cyano group, and an aryloxy group.

Compounds where n is an integer of 1 to 3 are preferred. Compounds where n=1 are most preferred. Preferably, $R_1$ to $R_{10}$ each represent a hydrogen atom, an alkyl group, an alkoxy group, a carbonamido group, a sulfonamido group, an alkylthio group, or a sulfo group.

Among the compounds represented by general formulae (LI) and (LII), the compounds of general formula (LI) or (LII) where at least one of $R_7$ and $R_8$ is a carbonamido group, a sulfonamido group, a carbamoyl group, or a sulfamoyl group are particularly preferred.

Representative, non-limiting examples of hydroquinone derivatives of the present invention include the following compounds.

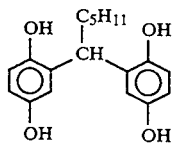

(LI)-1

-continued
(LI-2)
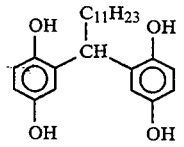
(LI-3)
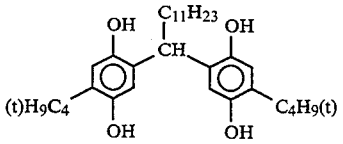
(LI-4)
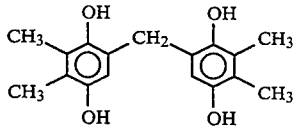
(LI-5)
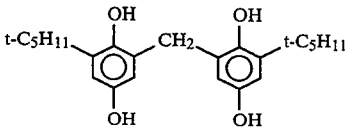
(LI-6)
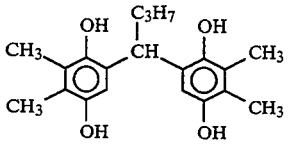
(LI-7)
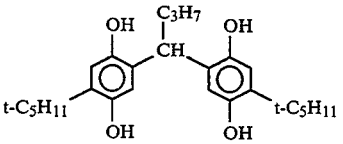
(LI-8)
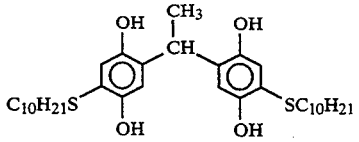
(LI-9)
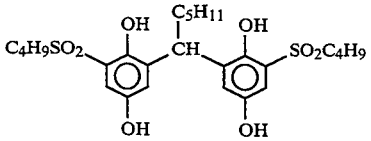
(LI-10)
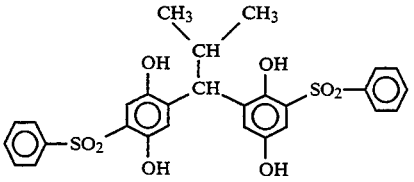
(LI-11)
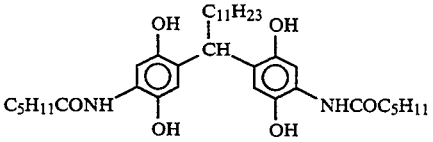
(LI-12)
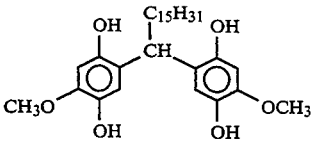
-continued
(LI-13)
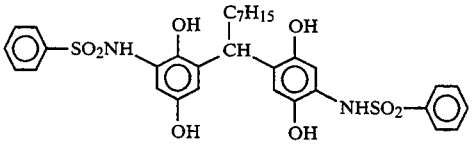
(LI-14)
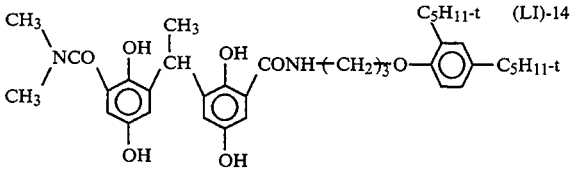
(LI-15)
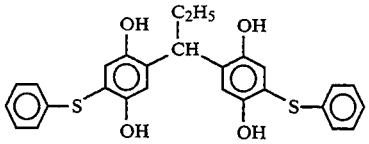
(LI-16)
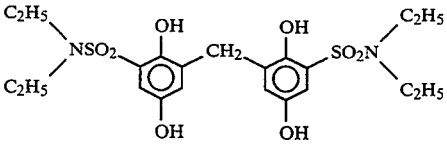
(LI-17)
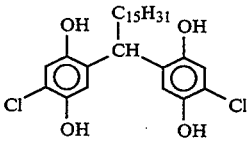
(LI-18)
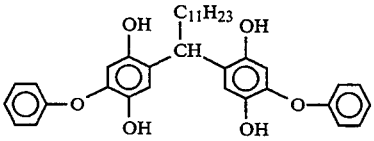
(LII-1)
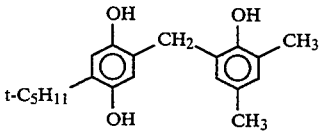
(LII-2)
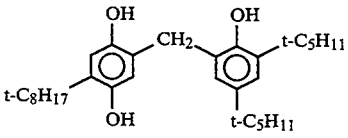
(LII-3)
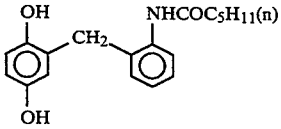
(LII-4)
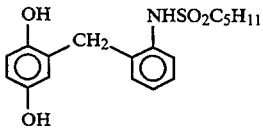
(LII-5)
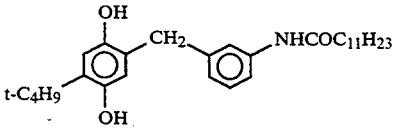

-continued (LII)-6

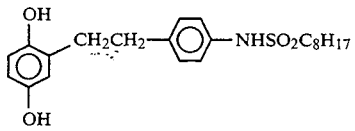

(LII)-7

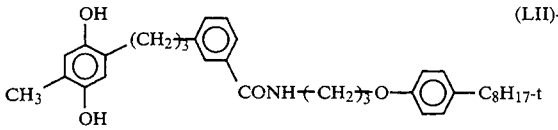

(LII)-8

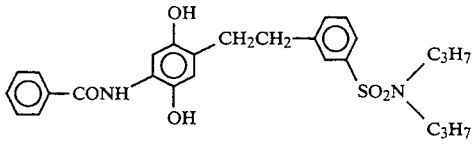

(LII)-9

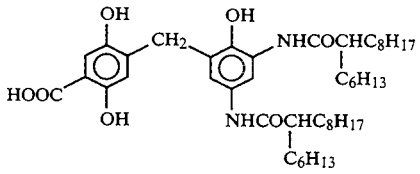

(LII)-10

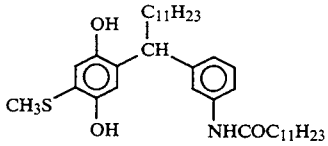

(LII)-11

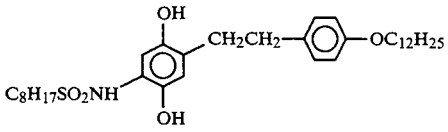

(LII)-12

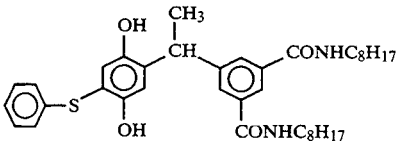

(LII)-13

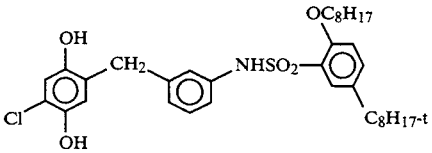

(LII)-14

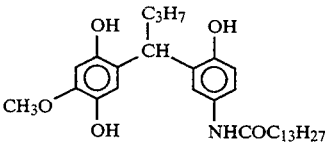

(LII)-15

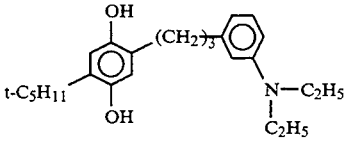

-continued (LII)-16

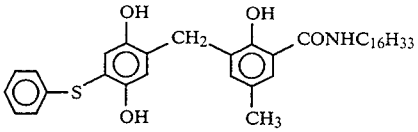

Hydroquinone derivatives of general formulae (LI) or (LII) according to the present invention can be synthesized according to the methods described in U.S. Pat. No. 2,735,765, JP-B-56-21145 (the term "JP-B" as used herein means an "examined Japanese patent publication") and JP-A-2-35451.

Hydroquinone derivatives of general formula (LI) or (LII) can be contained in given layers in a similar manner to hydrazine compounds and redox compounds. A remarkable effect is obtained when these hydroquinone derivatives are contained in layers other than a silver halide emulsion layer containing a hydrazine derivative. More preferably, these hydroquinone derivatives are in layers adjacent to the at least one silver halide emulsion layers containing hydrazine derivatives. The hydroquinone derivatives are used in an amount of preferably $1\times10^{-6}$ to $1\times10^{-1}$ mol, most preferably $1\times10^{-5}$ to $5\times10^{-2}$ mol per mol of silver halide on the side of the support having the layer where the hydroquinone derivative is added.

These compounds may be used in photographic materials in which the light-sensitive emulsion layers are only silver halide emulsion layers containing the hydrazine derivatives. However, when the compound are used in photographic materials having, as at least one second light-sensitive silver halide emulsion layers containing redox compounds which release a restrainer by oxidation, an even more remarkable effect is obtained. Such photographic materials are excellent for plate making, because they give very high contrast, have excellent gradation reproducibility, scarcely form black peppers, and are excellent for line work and gives good image quality in terms of spread and choke.

Hydrazine derivatives (hereinafter referred to as nucleating agents, sometimes) used in the present invention are preferably compounds represented by the following general formula (I).

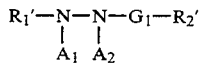

(I)

In the above formula, $R_1'$ represents an aliphatic group or an aromatic group; $R_2'$ represents a hydrogen atom, an alkyl group, an aryl group, an alkoxy group, an aryloxy group, an amino group or a hydrazine group;

$G_1$ represents a

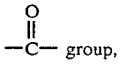

a —$SO_2$— group, a —SO— group,

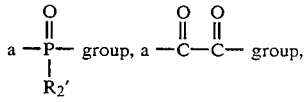

a thiocarbonyl group or an iminomethylene group; and $A_1$ and $A_2$ both represent a hydrogen atom, or one of $A_1$ and $A_2$ represents a hydrogen atom and the other represents a substituted or unsubstituted alkylsulfonyl group; a substituted or unsubstituted arylsulfonyl group; or a substituted or unsubstituted acyl group.

In general formula (I), the aliphatic group represented by $R_1'$ is a straight-chain, branched or cyclic alkyl group preferably having 1 to 30 carbon atoms, most preferably 1 to 20 carbon atoms. This alkyl group may be substituted.

In general formula (I), the aromatic group represented by $R_1'$ is a monocyclic or bicyclic aryl group or an unsaturated heterocyclic group. The unsaturated heterocyclic group may be condensed with the aryl group to form a condensed ring.

Preferably, $R_1'$ is an aryl group, an aryl group having a benzene ring is particularly preferred.

The aliphatic group or aromatic group represented by $R_1'$ may be substituted. Typical examples of substituent groups include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group, and a

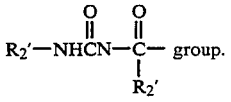

Preferred substituent groups include an alkyl group (preferably having 1 to 20 carbon atoms), an aralkyl group (preferably having 7 to 30 carbon atoms), an alkoxy group (preferably having 1 to 20 carbon atoms), a substituted amino group (preferably an amino group substituted by an alkyl group having 1 to 20 carbon atoms), an acylamino group (preferably having 2 to 30 carbon atoms), a sulfonamido group (having 1 to 30 carbon atoms), a ureido group (preferably having 1 to 30 carbon atoms) and a phosphoric acid amido group (having 1 to 30 carbon atoms).

In general formula (I), the alkyl group represented by $R_2'$ is an alkyl group preferably having 1 to 4 carbon atoms. The aryl group represented by $R_2'$ is preferably a monocyclic or bicyclic aryl group (e.g., an aryl group having benzene ring).

When $G_1$ is a

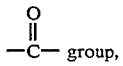

$R_2'$ is preferably a hydrogen atom, an alkyl group (e.g., a methyl group, a trifluoromethyl group, a 3-hydroxypropyl group, a 3-methanesulfonamidopropyl group, a phenylsulfonylmethyl group) , an aralkyl group (e.g. , an o-hydroxybenzyl group) or an aryl group (e.g., a phenyl group, a 3,5-dichlorophenyl group, an o-methanesulfonamidophenyl group, a 4-methanesulfonylphenyl group, a 2-hydroxymethylphenyl group with a hydrogen atom being particularly preferred.

The groups represented by $R_2'$ may be substituted. Examples of suitable substituent groups include those described above in the definition of the substituent groups for $R_1'$.

Most preferably, $G_1$ in general formula (I) is a

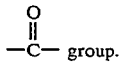

$R_2'$ may be a group which causes the cleavage of the $G_1$—$R_2'$ moiety from the residual moiety of the molecule and a cyclization reaction to form a ring structure containing the atoms of the $G_1$—$R_2'$ moiety. Examples of such group include those described in JP-A-63-29751.

Most preferably, $A_1$ and $A_2$ are a hydrogen atom.

$R_1'$ or $R_2'$ in general formula (I) may have a ballast group or a polymer in its structure, said ballast group or polymer being conventionally used in passive photographic additives such as polymers. The ballast group is a group which has at least 8 carbon atoms and is relatively inert in terms of photographic characteristics. For example, the ballast group can be an alkyl group, an alkoxy group, a phenyl group, an alkylphenyl group, a phenoxy group, or an alkylphenoxy group. Examples of the polymer include those described in JP-A-1-100530.

$R_1'$ or $R_2'$ in general formula (I) may have a group in its structure, which accelerates the adsorption on the surfaces of silver halide grains. Examples of such an adsorption group include a thiourea group, a heterocyclic thioamido group, a heterocyclic mercapto group, and a triazole group. These groups are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234246, and Japanese Patent Application No. 62-67501.

Non-limiting examples of compounds represented by general formula (I) according to the present invention include the following.

I-1

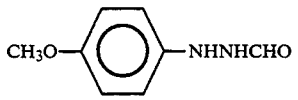

I-2

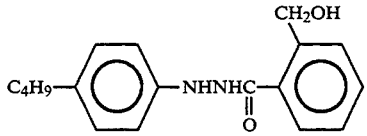

-continued
I-3
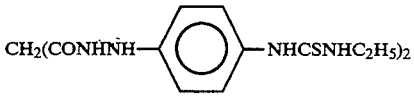
I-4
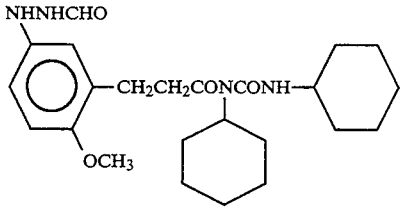
I-5
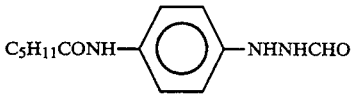
I-6
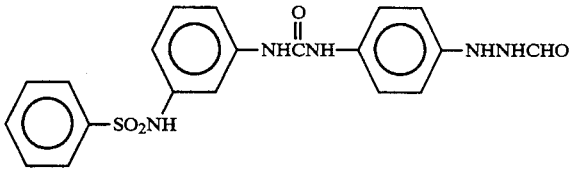
I-7
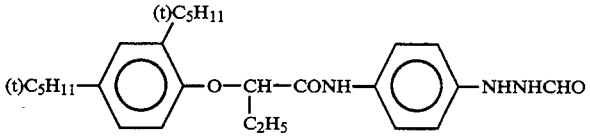
I-8
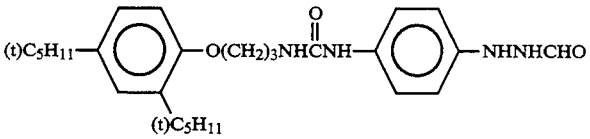
I-9
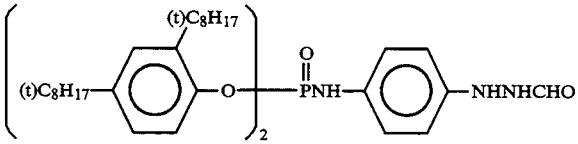
I-10
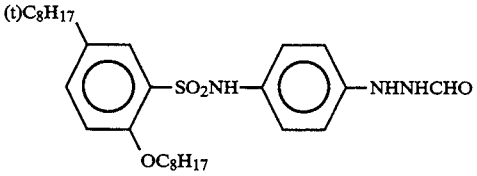
I-11
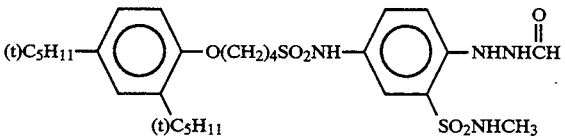
I-12
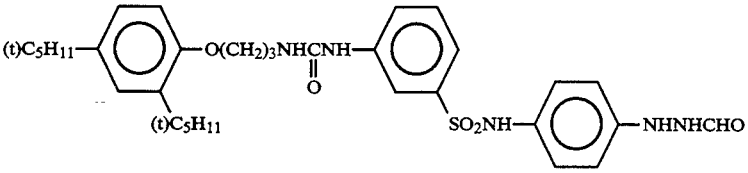

-continued
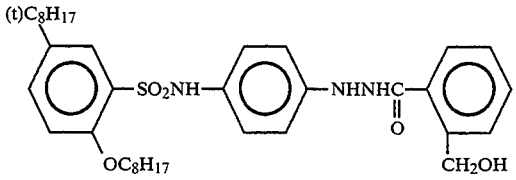
I-13
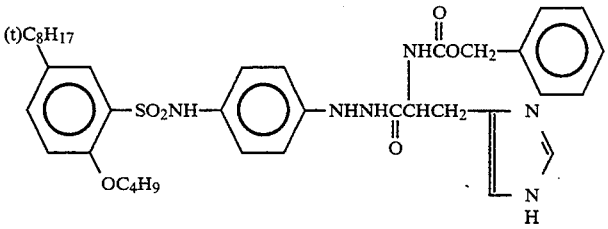
I-14
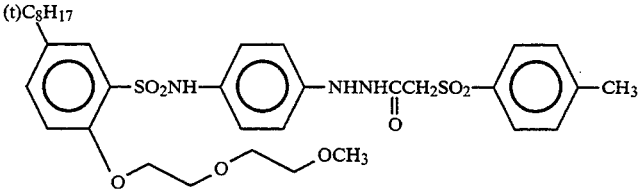
I-15
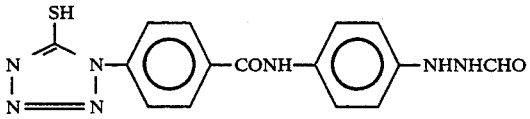
I-16
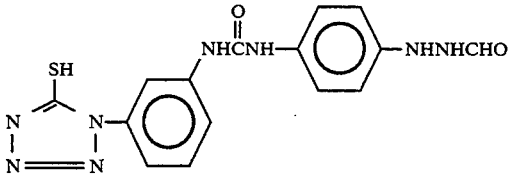
I-17
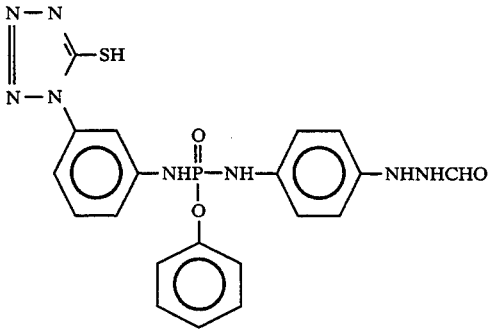
I-18
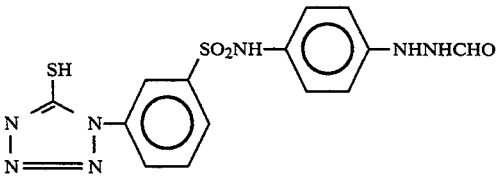
I-19
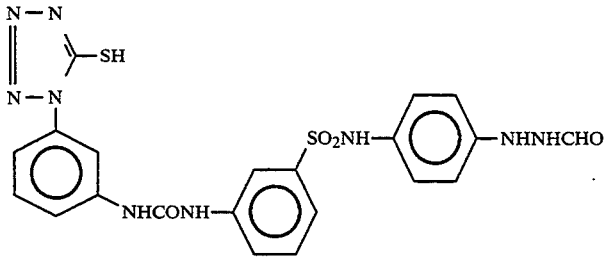
I-20
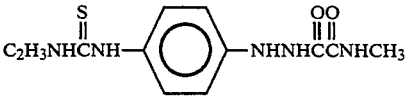
I-21
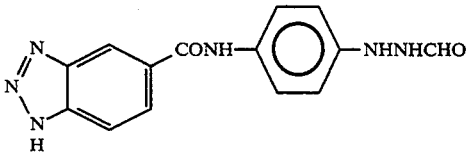
I-22

-continued

I-23

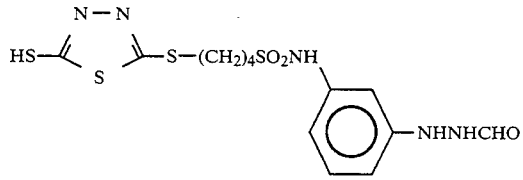

I-24

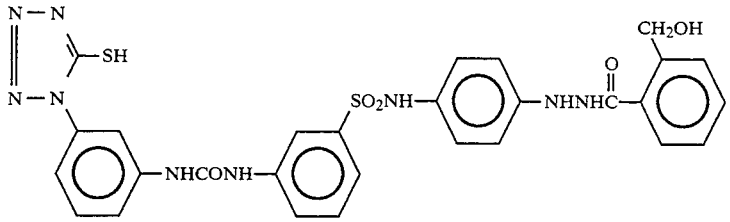

I-25

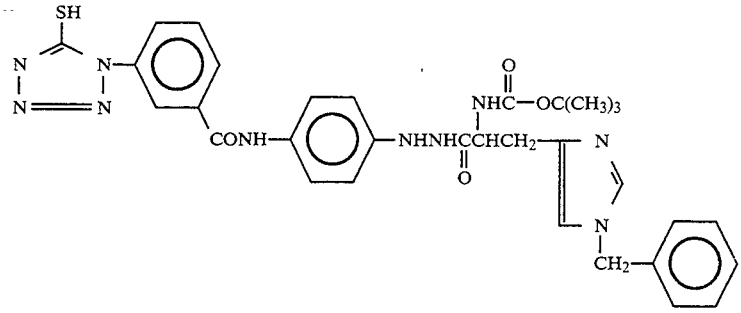

I-26

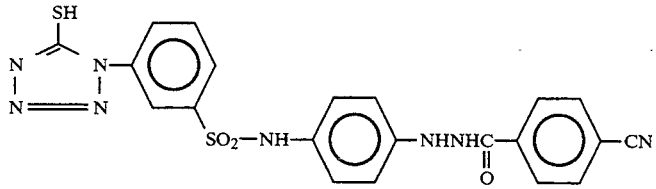

In addition to the above-described hydrazine derivatives, the hydrazine derivatives described in the following documents can be used: *Research Disclosure,* item 23516, p. 346 (November 1983) and the literature cited therein, U.S. Pat. Nos. 4,080,207, 4,269,929, 4,276,364, 4,278,748, 4,385,108, 4,459,347, 4,560,638 and 4,478,928, U.K. Patent 2,011,391B, JP-A-60-179734, JP-A-62-270948, JP-A-63-29751, JP-A-61-170733, JP-A-61-270744, JP-A-62-948, European Patent 217,310, U.S. Pat. No. 4,686,167, JP-A-62-178246, JP-A-63-32538, JP-A -63-104047, JP-A-63-121838, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, Japanese Patent Application Nos. 63-105682, 63-114118, 63-110051, 63-114119, 63-116239, 63-147939, 63-179760, 63-229163, 1-18377, 1-18378, 1-18379, 1-15755, 1-16814, 1-40792, 1-42615, 1-42616, 1-123693 and 1-126284.

The hydrazine derivatives may be added in any constituting layer in photographic materials, but they are preferably added in silver halide emulsion layers or layers adjacent to at least one silver halide emulsion layer, and more preferably added in silver halide emulsion layers.

In the present invention, the amounts of the hydrazine derivatives to be employed are in the range of preferably $1\times10^{-6}$ to $5\times10^{-2}$ mol, most preferably $1\times10^{-5}$ to $2\times10^{-2}$ mol per mol of silver halide on the side of the support having the layer where the hydrazine derivative is added.

Redox compounds which release a restrainer by oxidation are illustrated below.

Preferred examples of the redox groups of the redox compounds of the present invention include hydroquinones, catechols, naphthohydroquinones, aminophenols, pyrazolidones, hydrazines, hydroxylamines, and reductones. Among these, hydrazines are more preferable.

The redox compounds which release a restrainer by oxidation used in the present invention are preferably compounds represented by the following general formulae (R-1), (R-2), and (R-3). Among these, compounds of general formula (R-1) are particularly preferred.

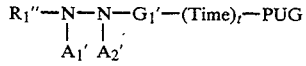

(R-1)

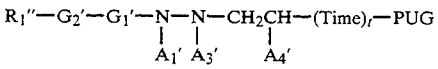

(R-2)

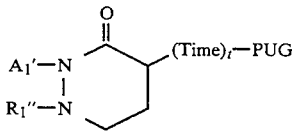

(R-3)

In the above formulae, $R_1''$ represents an aliphatic group or an aromatic group; $G_1'$ represents a $$-\overset{\overset{\displaystyle O}{\|}}{C}-\text{ group, a }-\overset{\overset{\displaystyle O}{\|}}{C}-\overset{\overset{\displaystyle O}{\|}}{C}-\text{ group, a }-\overset{\overset{\displaystyle S}{\|}}{C}-\text{ group,}$$

$$\text{a }-\overset{\overset{\displaystyle N-G_2'-R_2''}{\|}}{C}-\text{ group,}$$

a —SO— group, a $-SO_2-$ group or a $$-\overset{\overset{\displaystyle O}{\|}}{\underset{\underset{\displaystyle G_2'-R_2''}{|}}{P}}-\text{ group;}$$

$G_2'$ represents a single bond, —O—, —S— or $$-\underset{\underset{\displaystyle R_2''}{|}}{N}-;$$

$R_2''$ represents a hydrogen atom or $R_1''$; and $A_1'$ and $A_2'$ each represent a hydrogen atom, an alkylsulfonyl group which may be substituted, an arylsulfonyl group which may be substituted, or an acyl group which may be substituted. In general formula (R-1), at least one of $A_1'$ and $A_2'$ is hydrogen atom. $A_3'$ has the same meaning as $A_1'$ or represents a $$-CH_2\underset{\underset{\displaystyle A_4'}{|}}{CH}\left(\text{Time}\right)_t\text{PUG}$$

group; $A_4'$ represents a nitro group, a cyano group, a carboxyl group, a sulfo group, or a $-G_1'-G_2'-R_1''$ group; Time represents a bivalent bonding group; t represents 0 or 1; and PUG represents a restrainer.

The compounds of general formulae (R-1), (R-2), and (R-3) are illustrated in more detail below.

In (R-1), (R-2) and (R-3), the aliphatic group represented by $R_1''$ is a straight-chain, branched or cyclic alkyl group preferably having 1 to 30 carbon atoms; most preferably 1 to 20 carbon atoms. The alkyl group may be substituted.

In general formulae (R-1), (R-2), and (R-3), the aromatic group represented by $R_1''$ is a monocyclic or bicyclic aryl group or an unsaturated heterocyclic group. The unsaturated heterocyclic group may be condensed with the aryl group to form a heteroaryl group.

Examples of this aromatic group include a benzene ring, a naphthalene ring, a pyridine ring, a quinoline ring, and an isoquinoline ring. Among these, a group having a benzene ring is preferred.

Most preferably, $R_1''$ is an aryl group.

The aryl group or the unsaturated heterocyclic group may be substituted. Typical examples of substituent groups include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, and a phosphoric acid amido group. Preferred substituent groups are a straight-chain, branched or cyclic alkyl group (preferably having 1 to 20 carbon atoms), an aralkyl group (preferably having 7 to 30 carbon atoms), an alkoxy group (preferably having 1 to 30 carbon atoms), a substituted amino group (preferably an amino group substituted by an alkyl group having 1 to 30 carbon atoms), an acylamino group (preferably having 2 to 40 carbon atoms), a sulfonamido group (having preferably 1 to 40 carbon atoms), a ureido group (preferably having 1 to 40 carbon atoms) and a phosphoric acid amido group (having preferably 1 to 40 carbon atoms).

In general formulae (R-1), (R-2) and (R-3), $G_1'$ is preferably $$-\text{a}-\overset{\overset{\displaystyle O}{\|}}{C}-$$

or a $-SO_2-$ group with a $$-\overset{\overset{\displaystyle O}{\|}}{C}-$$

group most preferred.

$A_1'$ and $A_2'$ are preferably a hydrogen atom, and $A_3'$ is preferably a hydrogen atom or a $$-CH_2\underset{\underset{\displaystyle A_4'}{|}}{CH}\left(\text{Time}\right)_t\text{PUG group.}$$

In general formulae (R-1), (R-2), and (R-3), Time represents a bivalent bonding group and may have a timing controlling function.

The bivalent bonding group represented by Time is a group which is released from Time-PUG through one or more step reactions, the (Time—PUG moiety being released from the oxidant of an oxidation-reduction mother nucleus.

Examples of the bivalent bonding group represented by Time include those which release PUG by an intramolecular cyclization of p-nitrophenoxy derivatives as described in U.S. Pat. No. 4,248,962 (JP-A-54-145135); those which release PUG by an intramolecular cyclization reaction after ring cleavage as described in U.S. Pat. Nos. 4,310,612 (JP-A-55-53330) and 4,358,525; those which release PUG by the intramolecular cyclization reaction of a carboxyl group of succinic monoesters or analogs thereof with the formation of acid anhydride as described in U.S. Pat. Nos. 4,330,617, 4,446,216, and 4,483,919 and JP-A-59-121328; those which release PUG by electron transfer through a double bond conjugated with an aryloxy group or a heterocyclic oxy group together with the formation of quinomonomethane or analogs thereof as described in U.S. Pat. Nos. 4,409,323 and 4,421,845, *Research Disclosure* No. 21228 (December 1981), U.S. Pat. No. 4,416,977 (JP-A-57-135944), JP-A-58-209736 and JP-A-58-209738; those which release PUG from the γ-position of an enamine by electron transfer in a moiety having an enamine structure in nitrogen-containing heterocyclic ring as described in U.S. Pat. No. 4,420,554 (JP-A-57-136640), JP-A-57-135945, JP-A-57-188035, JP-A-58-98728 and JP-A-58-209737; those which release PUG by the intramolecular cyclization reaction of oxy group formed by electron transfer to a carbonyl group conjugated with a nitrogen atom in a nitrogen-containing heterocyclic ring as described in JP-A-57-56837; those which release PUG with the formation of aldehydes as described in U.S. Pat. No. 4,146,396 (JP-A-52-90932), JP-A-59-973442, JP-A-59-75747, JP-A-60-249148 and JP-A-60-249149; those which release PUG with a decarboxylation of a carboxyl group as described in JP-A-51-146828, JP-A-57-179842 and JP-A-59-104641; those which have a structure of —O—COOCR$_a$R$_b$—PUG (wherein R$_a$ and R$_b$ are each a monovalent group) and release PUG with the formation of aldehydes subsequent to decarboxylation; those which release PUG with the formation of isocyanates as described in JP-A-60-7429; and those which release PUG by a coupling reaction with the oxidants of color developing agents as described in U.S. Pat. No. 4,438,193.

Specific examples of these bivalent bonding groups represented by Time are described in detail in JP-A-61-236549 and JP-A-1-269936 for example.

PUG represents a group which has a restraining effect as (Time)$_t$PUG or PUG.

Restrainers represented by PUG or (Time)$_t$PUG are conventional restrainers which have a hetero-atom and are bonded through a hetero-atom. These restrainers are described in, for example, C. E. K. Mess and T. H. James, *The Theory of the Photographic Processes,* third edition, pp. 344–346 (1966 Macmillan).

The restrainers represented by PUG may be substituted. Examples of substituent groups include those described above in the definition of the substituent groups for R$_1$". These substituent groups may be further substituted.

Preferred substituent groups include a nitro group, a sulfo group, a carboxyl group, a sulfamoyl group, a phosphono group, a phosphinico group, and a sulfonamido group.

In general formulae (R-1), (R-2), and (R-3), R$_1$" or (Time)$_t$PUG has a ballast group or an adsorption accelerating group in its structure such a ballast group is conventionally used in passive photographic additives such as couplers and such an adsorption accelerating group is a group which accelerates the adsorption of the compounds of general formulae (R-1), (R-2), and (R-3) on silver halide.

The ballast group is an organic group which gives sufficient molecular weight to the compounds of general formulae. (R-1), (R-2), and (R-3) so that they do not substantially diffuse into other layers or processing solutions. This ballast group is composed of an alkyl group, an aryl group, a heterocyclic group, an ether group, a thioether group, an amide group, a ureido group, a urethane group, a sulfonamido group, or a combination of two or more of these groups. A ballast group having a substituted benzene ring is preferred. A ballast group having a branched alkyl group substituted benzene ring is particularly preferred.

Examples of the adsorption accelerating group are a cyclic thioamido group, a linear thioamido group, an aliphatic mercapto group, an aromatic mercapto group, a heterocyclic mercapto group (when the atom next to the carbon atom to which the —SH group is attached is a nitrogen atom, a heterocyclic mercapto group and a cyclic thioamido group exist in tautomeric form), which are equivarent, and a group having a disulfide bond (such as 4-thiazoline-2-thione, 4-imidazoline-2-thione, 2-thiohydantoin, rhodanine, thiobarbituric acid, tetrazoline-=5-thione, 1,2,4-triazoline-3-thione, 1,3,4-oxazoline-2-thione, benzimidazoline-2-thione, benzoxazoline-2-thione, benzthiazoline-2-thione, thiotriazine and 1,3-imidazoline-2-thione); a 5-membered to 6-membered nitrogen-containing heterocyclic group composed of a combination of carbon and nitrogen, oxygen and/or sulfur atoms (such as benztriazole, triazole, tetrazole, indazole, benzimidazole, imidazole, benzthiazole, thiazole, benzoxazole, oxazole, oxazoline, thiadiazole, oxathiazole, triazine and azaindene); and heterocyclic quaternary salts (such as benzimidazolium).

These groups may be substituted by one or more appropriate substituent groups.

Examples of the substituent groups include those described above in the definition of the substituent groups for R$_1$".

The following are non-limiting examples of the compounds corresponding to general formulae (R-1), (R-2), and (R-3) that can be used in the present invention.

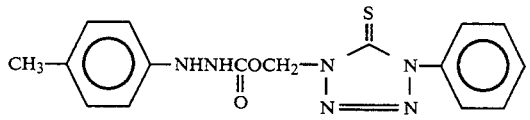

3-1

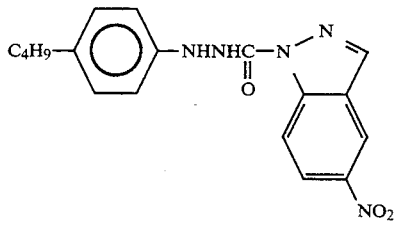

3-2

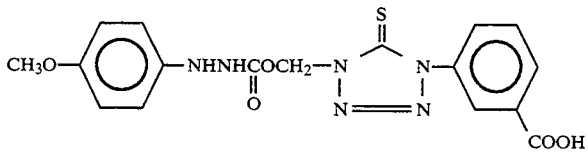

3-3

-continued
3-4
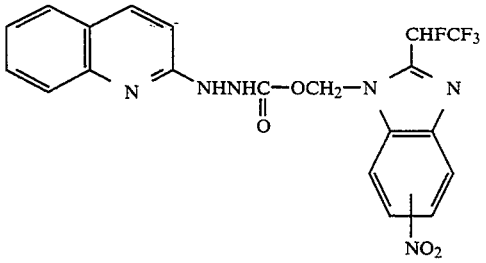
3-5
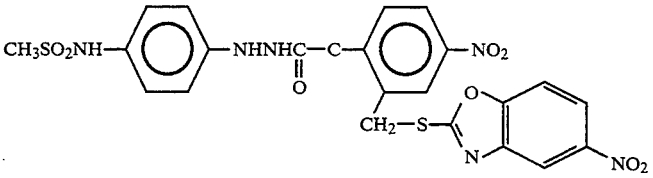
3-6
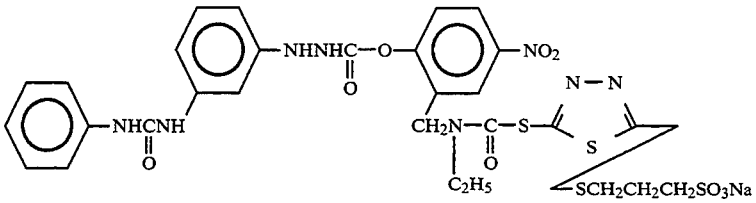
3-7
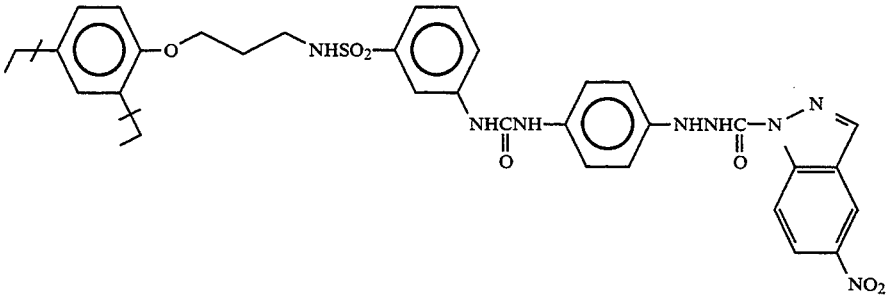
3-8
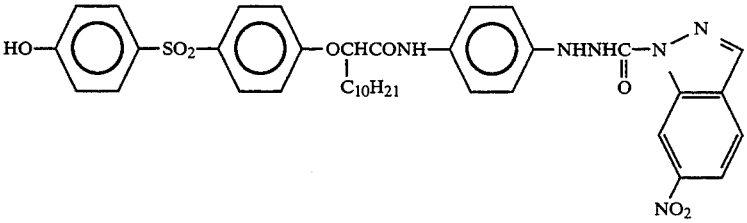
3-9
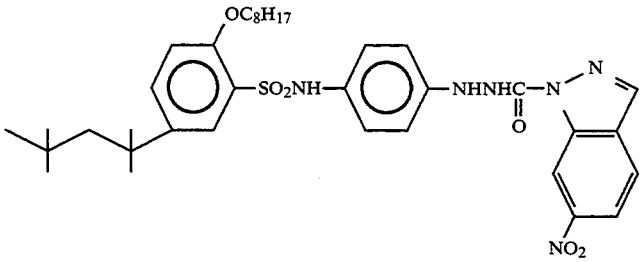

-continued
3-10
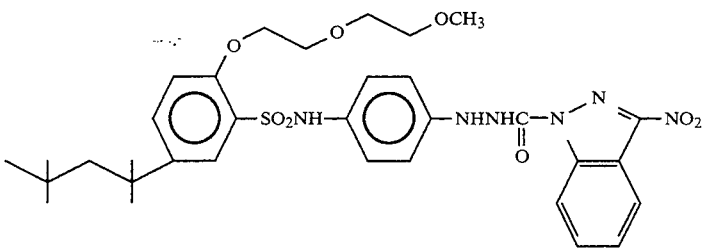
3-11
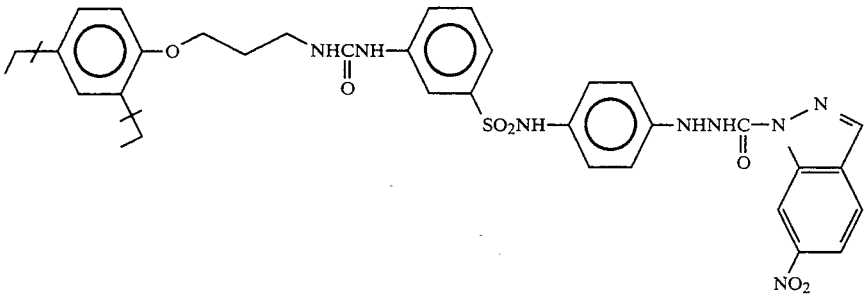
3-12
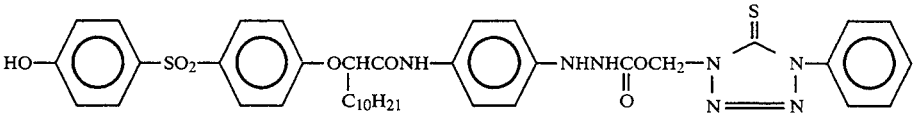
3-13
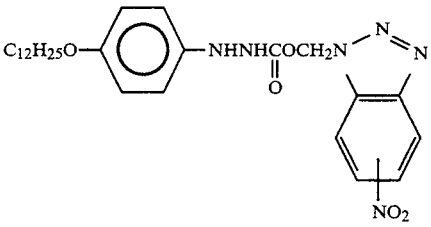
3-14
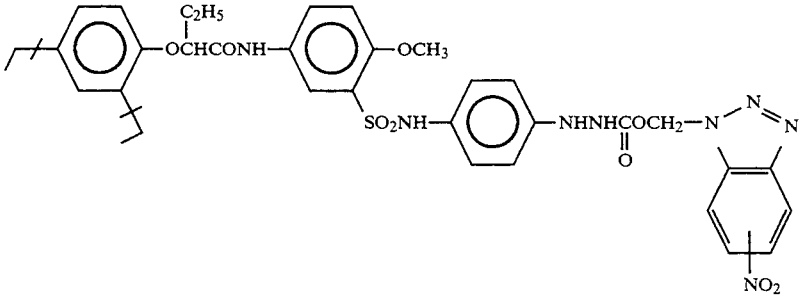
3-15
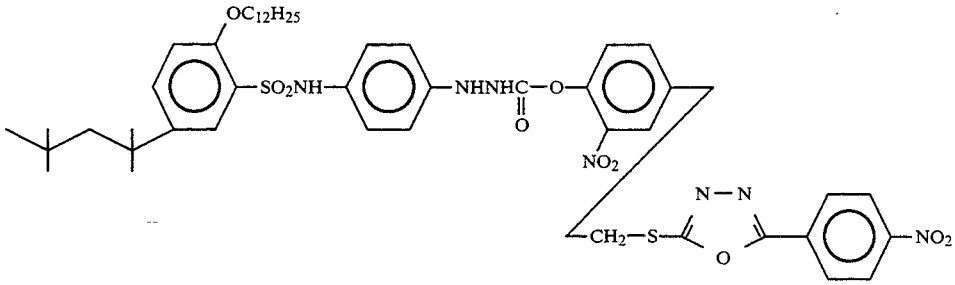

-continued
3-16
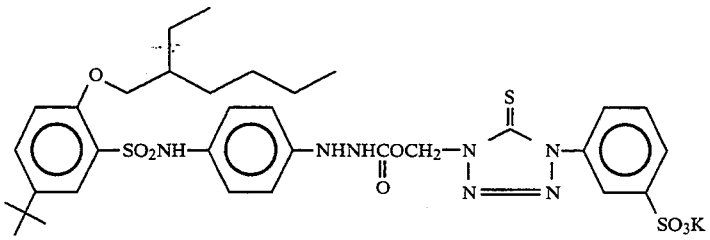
3-17
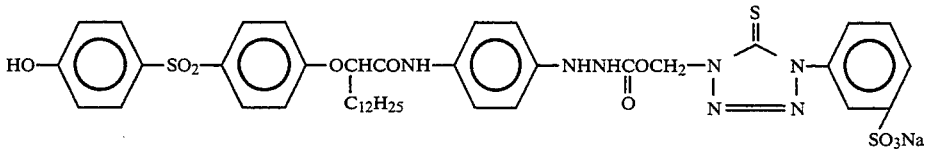
3-18
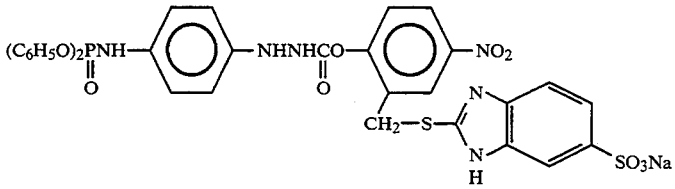
3-19
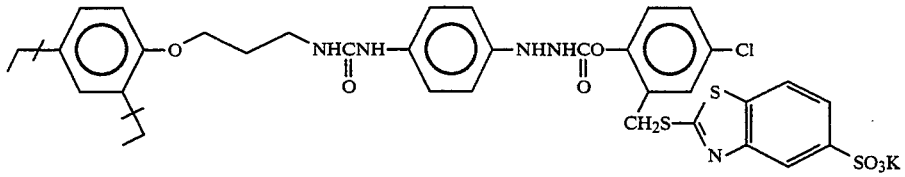
3-20
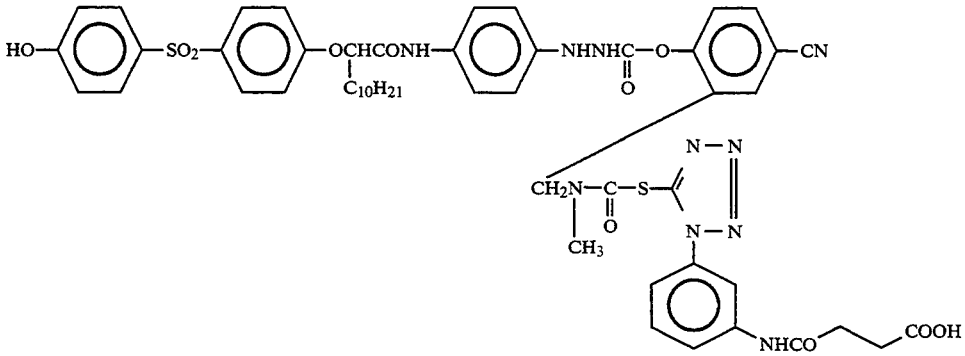
3-21
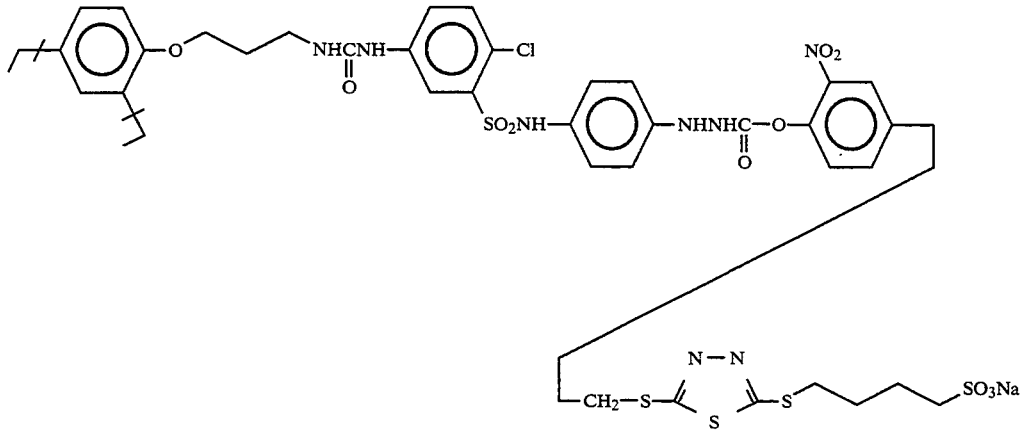

-continued
3-22
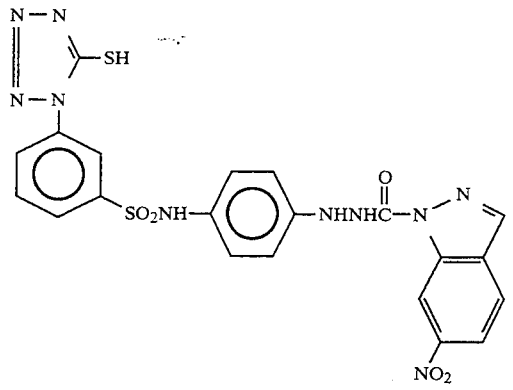
3-23
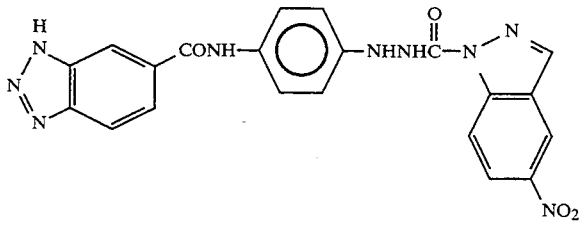
3-24
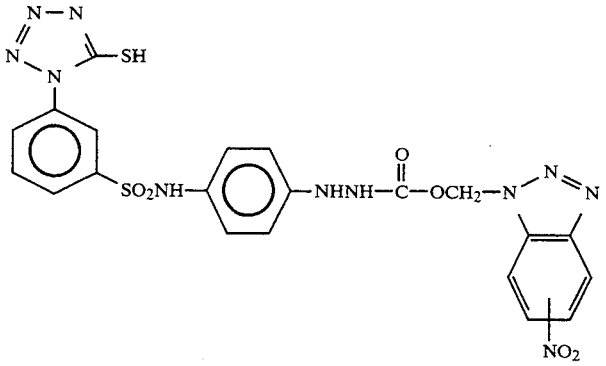
3-25
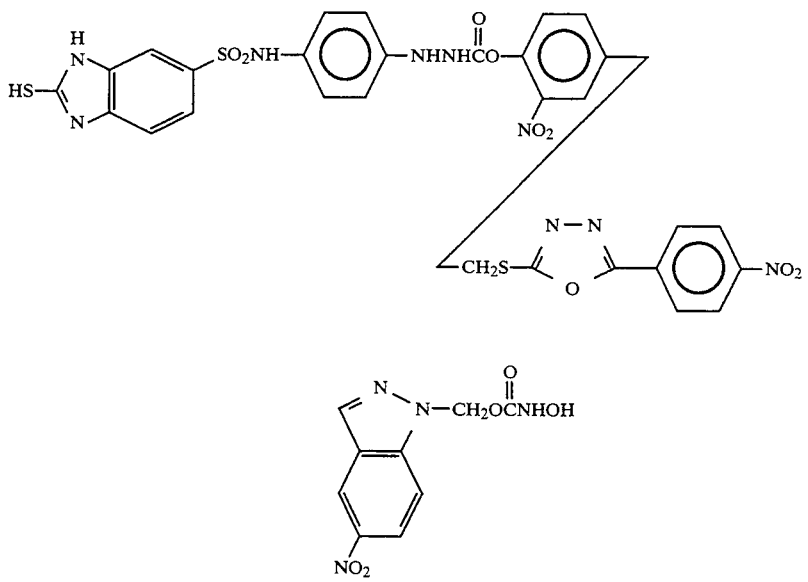

-continued
3-26
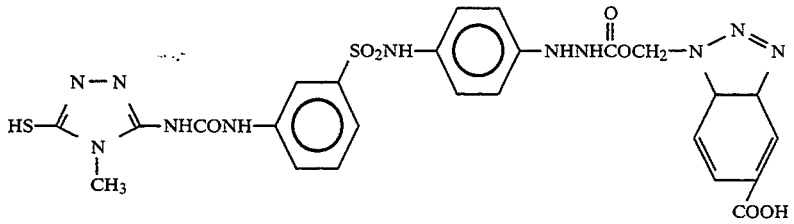
3-27
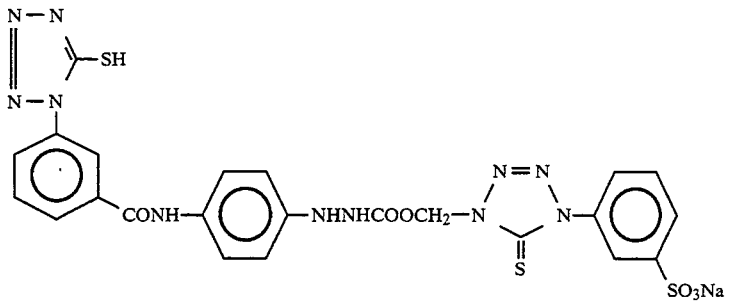
3-28
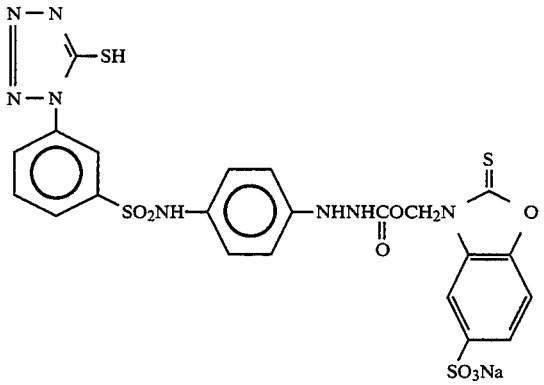
3-29
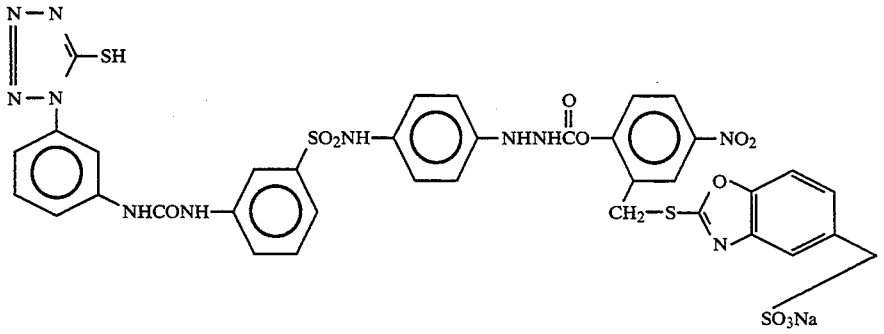
3-30
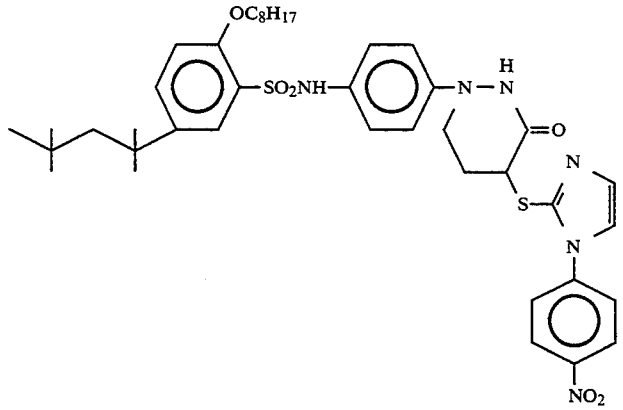

-continued
3-31
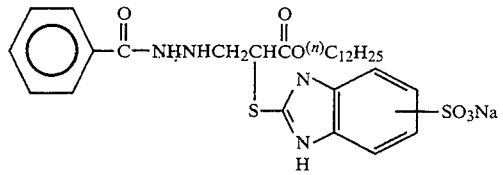
3-32
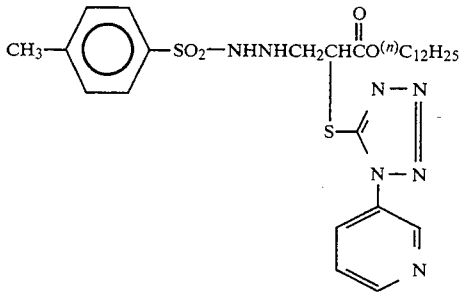
3-33
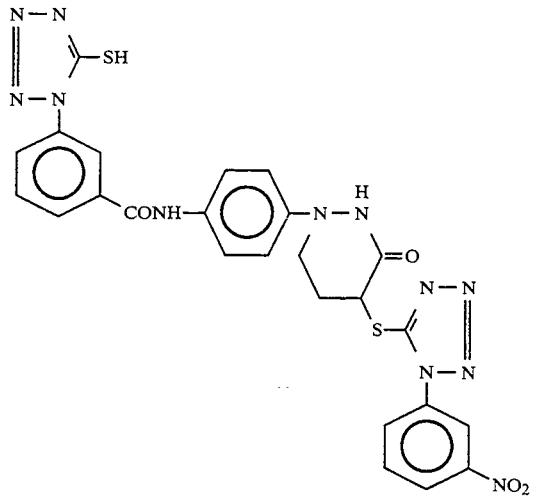
3-34
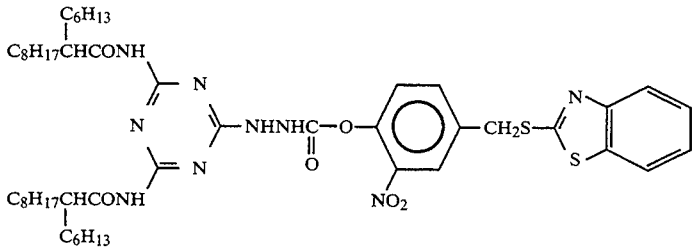
3-35
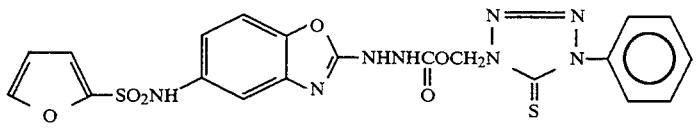
3-36
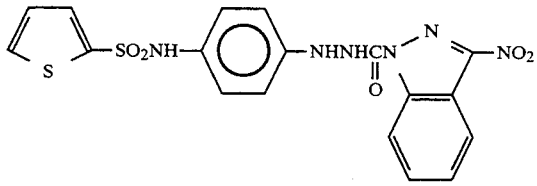
In addition to the above-described compounds, redox compounds described in JP-A-61-213847, JP-A-62-260153, JP-A-1-102393, JP-A-1-102394, JP-A-1-102395 and JP-A-1-114455 can be used in the present invention.

Methods for synthesizing the redox compounds which can be used in the present invention are described in JP-A-61-213847, JP-A-62-260153, U.S. Pat. No. 4,684,604, Japanese Patent Application No. 63-98803, U.S. Pat. Nos. 3,379,529, 3,620,746, 4,377,634 and 4,332,878, JP-A-49-129536, JP-A-56-153336 and JP-A-56-153342.

The redox compounds of the present: invention are used in an amount of $1\times10^{-6}$ to $5\times10^{-2}$ mol, preferably $1\times10^{-5}$ to $1\times10^{-2}$ mol per mol of silver halide on the side of the support having the layer where the redox compound is added.

The hydrazine derivatives and the redox compounds of the present invention can be used by dissolving them in appropriate water-miscible organic solvents such alcohols (e.g., methanol, ethanol, propanol, or fluorinated alcohol), ketones (e.g., acetone, methyl ethyl ketone), dimethylformamide, dimethyl sulfoxide, or methyl cellosolve.

These redox compounds can also be dissolved using oil such as dibutyl phthalate, tricresyl phosphate, glycerol triacetate, or diethyl phthalate or a co-solvent such as ethyl acetate or cyclohexanone and then emulsifying and mechanically dispersing the resulting solution by conventional emulsifying dispersion methods to prepare an emulsified dispersion. Alternatively, powdered redox compound can be dispersed in water using a ball mill, a colloid mill, or by ultrasonic dispersion means (a solid dispersion method).

The redox compounds can be added in any constituting layer in photographic materials. Layers containing the redox compounds of the present invention are preferably provided above and below the sensitive emulsion layers containing hydrazine nucleating agent. The layers containing the redox compounds of the present invention may also contain sensitive or non-sensitive silver halide emulsion grains. An interlayer containing gelatin or a synthetic polymer (e.g., polyvinyl acetate, or polyvinyl alcohol) may be provided between the layer containing the redox compound of the present invention and the sensitive emulsion layer containing the hydrazine nucleating agent.

The silver halide used in the silver halide emulsions of the present invention may be silver chloride, silver chlorobromide, silver iodobromide, and silver iodochlorobromide.

With regard to the silver halide grains of the present invention, fine grains having a mean grain size of not larger than 0.7 $\mu$, particularly not larger than 0.5 $\mu$ are preferable.

Though there is no particular limitation with regard to grain size distribution, monodisperse system is preferable. The term "monodisperse" as used herein means that at least 95% (in terms of weight or the number of grains) of the grains of which the emulsion is composed are grains having a grain size of within ±40% of the mean grain size.

More preferably, the silver halide used in the silver halide emulsions of the present invention is silver chlorobromide or silver iodochlorobromide, each having a silver chloride content of from 50 mol % to 100 mol %. Silver iodide content is preferably not higher than 3 mol %, more preferably, not higher than 0.5 mol %.

The silver halide grains in the photographic emulsions may helve a regular crystal form such as a cube or an octahedron, an irregular crystal form such as sphere or plate form or a composite form of these crystal forms.

Silver halide grain may be composed of a uniform phase where the interior and surface layer are uniform, or different phases where the interior and surface layer are different from each other. Alternatively, two or more kinds of silver halide emulsions which are separately prepared may be mixed.

Monodisperse silver halide emulsions used in the present invention can be prepared by various methods which are known in the art. For example, appropriate silver halide emulsions can be prepared according to the methods described in P. Glafkides, *Chimie et Physique Photograhique* (Paul Montel 1967), G. F. Duffin, *Photographic Emulsion Chemistry* (The Focal Press 1966) and V. L. Zelikman et. al., *Making and Coating Photographic Emulsion* (The Focal Press 1964).

Monodisperse emulsions in the present invention have a coefficient of variation of preferably not higher than 20%, most preferably not higher than 15%.

The coefficient of variation is defined by the following formula.

$$\text{Coefficient of variation (\%)} = \frac{\text{Standard deviation of grain size}}{\text{Mean grain size}} \times 100$$

Grains in a use for monodisperse silver halide emulsion have a mean grain size of not larger than 0.5 $\mu$m, most preferably 0.1 to 0.4 $\mu$m.

A water-soluble silver salt (e.g., an aqueous solution of silver nitrate) and a water-soluble halide can be reacted by any single jet process, the double jet process, or a combination thereof. Also useful are a controlled jet process wherein the pAg of the liquid phase in which the silver halide is formed is kept constant. It is preferred that grains are formed using solvents for silver halide, such as ammonia, thioether, and tetra-substituted thioureas.

Tetra-substituted thiourea compounds described in JP-A-53-82408 and JP-A-55-77737 are more preferred. Most preferred thiourea compounds are tetramethylthiourea and 1,3-dimethyl-2-imidazolidinethione.

When grains are formed by the controlled double jet process using solvents for silver halide, silver halide emulsions having a regular crystal form and a narrow grain size distribution can easily be prepared. Thus, this method is an effective means for preparing the emulsions according to the present invention.

It is preferred that the grains of the monodisperse emulsions have a regular crystal form such as a cube, an octahedron, or a tetradecahedron; the cube form being particularly preferred.

Silver halide grain may be composed of a uniform phase wherein interior and surface layer are uniform, or different phases wherein interior and surface layer are different from each other as mentioned above.

Cadmium salt, sulfite, lead salt,, thallium salt, rhodium salt or a complex salt thereof, or iridium salt or a complex salt thereof may be allowed to coexist during the formation of the silver halide grains or the physical ripening thereof in preparation of the silver halide emulsions of the present invention.

In the present invention, silver halide emulsions particularly suitable for use in photographic materials for photographing line drawings and the formation of halftone dots are emulsions prepared by allowing $10^{-8}$ to $10^{-5}$ mol (per mol of silver) of an iridium salt or a complex salt thereof to coexist during the formation of the silver halide grains.

It is desirable that iridium salt in an amount described above is added before the completion of physical ripening, particularly during the formation of grains in the preparation of a silver halide emulsion. This iridium salt used above is a water-soluble iridium salt or iridium complex salt. Examples of such an iridium salt include iridium trichloride, iridium tetrachloride, potassium hexachloroiridate (III), potassium hexachloroiridate (IV), and ammonium hexachloroiridate (III).

The emulsion layers and other hydrophilic colloid layers of the present invention may contain water-soluble dyes as filter dyes or for the prevention of irradiation, etc. As filter dyes, there are used dyes for further lowering photographic sensitivity, preferably ultraviolet light absorbers having a spectral absorption maximum in a sensitivity region specific to silver halide or dyes substantially having light absorption in the region of 350 to 600 nm to enhance safety against safelight when used as roomlight photographic materials.

These dyes are added to the emulsion layers as necessary. Alternatively, the dyes together with mordant are added to a layer above the silver halide emulsion layer, that is, to a non-sensitive hydrophilic colloid layer which is farther away from the support than the silver halide emulsion layer to fix them.

The amounts of the dyes to be added vary depending on the molecular extinction coefficients of the dyes, but are generally in the range of $10^{-2}$ to 1 g/m$^2$, preferably 50 to 500 mg/m$^2$.

The dyes are described in detail in JP-A-63-64039. The following are non-limiting examples of such dyes.

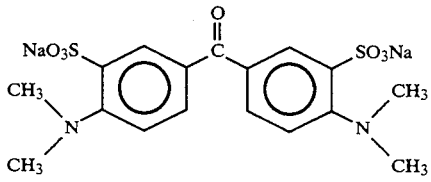

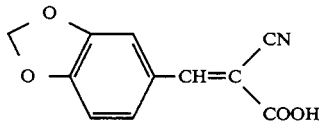

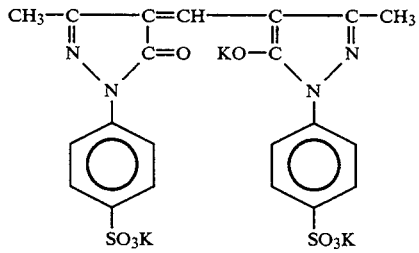

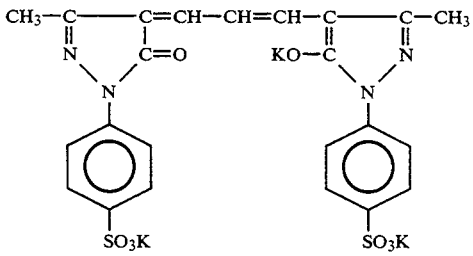

-continued

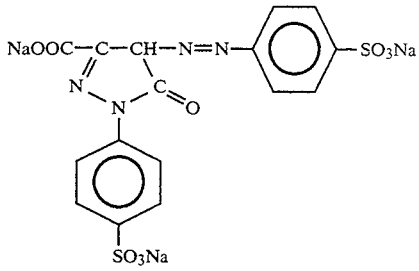

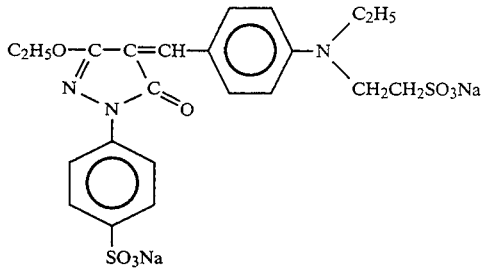

The above-described dyes are dissolved in appropriate solvents (e.g., water, alcohols (e.g., methanol, ethanol, or propanol), acetone, methyl cellosolve, etc. or a mixed solvent thereof) and then added to coating solutions for the non-sensitive hydrophilic colloid layers of the present invention.

These dyes may be used in a combination of two or more.

The dyes of the present invention are used in an amount to provide roomlight photographic materials.

Specifically, the dyes are used in an amount of generally $10^{-3}$ to 1 g/m$^2$, preferably $10^{-3}$ to 0.5 g/m$^2$.

Gelatin can be advantageously used as a binder or protective colloid for photographic emulsions. However, other hydrophilic colloids in addition to gelatin can be used. For example, there can be used protein such as gelatin derivatives, graft polymers of gelatin with other high-molecular materials, albumin and casein, cellulose derivatives such as hydroxyethyl cellulose, carboxymethy cellulose and cellulose sulfate, sodium alginate, saccharose derivatives such as starch derivatives, and various synthetic hydrophilic high-molecular materials such as homopolymers, for example, polyvinyl alcohol, polyvinyl alcohol partial acetal, poly-N-pyrrolidone, polyacrylic acid, polymethacrylic acid, polyacrylamide, polyvinyl imidazole and polyvinyl pyrazole and copolymers thereof.

More specific examples of gelatin which can be used in the present invention include lime-processed gelatin, acid-processed gelatin, hydrolyzate of gelatin, and enzymatic hydrolyzate of gelatin.

It is not required that silver halide emulsions which are used in the present invention are subjected to chemical sensitization. However, the silver halide emulsions may be subjected to chemical sensitization. Examples of such chemical sensitizations include conventional sulfur sensitization, reduction sensitization, and noble metal sensitization. These chemical sensitization methods may be used either alone or in combination.

It is preferred that the monodisperse emulsions of the present invention are subjected to chemical sensitization. Sulfur sensitization, reduction sensitization, and gold sensitization can be used alone or in combination. Preferred chemical sensitization methods are gold and sulfur sensitization methods.

Sulfur sensitizing agents include sulfur compounds contained in gelatin and other various sulfur compounds such as thiosulfates, thioureas, thiazoles and rhodanines. Specific examples of sulfur sensitizing agents are described in U.S. Pat. Nos. 1,574,944, 2,278,947, 2,410,689, 2,728,668, 3,501,313 and 3,656,955. Preferred sulfur compounds are thiosulfates and thiourea compounds. During chemical sensitization, the pAg is preferably not higher than 8.3, more preferably 7.3 to 8.0. Further, combinations of polyvinyl pyrrolidone with thiosulfates give favorable results as reported by Moisar, *Klein Gelatine. Proc. Syme.* 2nd, 301~309 (1970).

A typical example of a noble metal sensitization method is a gold sensitization method using gold compounds such as gold complex salts. Complex salts of platinum, palladium and iridium may also be used. Concrete examples these are described in U.S. Pat. No. 2,448,060 and U.K. Patent 618,061.

Examples of reduction sensitizing agents include. stannous salts, amines, formamidinesulfinic acids and silane compounds.

The silver halide emulsion layers of the present invention may contain conventional spectral sensitizing agents.

Sensitizing dyes (e.g., cyanine dyes, merocyanine dyes) having absorption maximum in the visible region as described in JP-A-55-52050 (pages 45 to 53) can be used in the present invention. By using such spectral sensitizing agents, silver halide can be spectral-sensitized to a longer wavelength side than the normal sensitization region inherent in silver halide.

These sensitizing dyes may be used either alone or in combination. Combinations of the sensitizing dyes are often used for the purpose of supersensitization. In addition to the sensitizing dyes, the emulsions may contain a dye which itself has no spectral sensitization effect, or a substance which does substantially not absorb visible light, but has a supersensitization effect.

Useful sensitizing dyes, combinations of dyes for supersensitization, and substances having a supersensitization effect are described in *Research Disclosure,* Vol. 176, No. 17643, page 23, item 1V-J (December 1978).

The photographic materials of the present invention may contain various compounds to prevent fogging caused during the preparation, storage, or processing of the photographic materials, or to stabilize photographic performance. Examples of such compounds include known anti-fogging agents or stabilizers such as azoles (for example, benzthiazolium salts , nitroindazoles, chlorobenzimidazoles, bromobenzimidazoles , mercaptotetrazoles, mercaptothiazoles, mercaptothiadiazoles, aminotriazoles, benzthiazoles and nitrobenztriazoles); mercaptopyrimidines; mercaptotriazines; thioketo compounds (such as oxazolinethione); azaindenes (such as triazaindenes, tetrazaindenes (particularly 4-hydroxy substituted (1,3,3a,7)tetrazaindenes) and pentazaindenes); and benzenethiosulfonic acids, benzenesulfinic acid and benzenesulfonamide. Among these compounds, the benztriazoles (e.g., 5-methylbenztriazole) and nitroindazoles (e.g., 5-nitroindazole) are preferred. If desired, these compounds may be added to the processing solutions. .Further, compounds which release a restrainer during development, as described in JP-A-62-30243, may be used as stabilizers or to prevent black pepper from being formed.

The photographic materials of the present invention may .contain developing agents such as hydroquinone derivatives and phenidone derivatives as stabilizers, or accelerators, for example.

The photographic emulsion layers and other hydrophilic colloid layers of the photographic materials of the present invention may contain inorganic or organic hardening agents. Examples of useful hardening agents include chromium salts (e.g., chromium alum or chromium acetate), aldehydes (e.g., formaldehyde or glutaraldehyde), N-methylol compounds (e.g., dimethylol urea), dioxane derivatives, active vinyl compounds (e.g., 1,3,5-triacryloyl-hexahydro-s-rtiazine, or 1,3-vinylsulfonyl-2-propanol), active halogen compounds (e.g., 2,4-dichloro-6-hydroxy-s-triazine) and mucohalogenic acids (e.g., mucochloric acid). These compounds may be used either alone or in combination.

The photographic emulsion layers or other hydrophilic colloid layers of the photographic materials of the present invention may contain various surfactants as a coating aid or for the purposes of imparting antistatic properties, improving slipperiness, emulsification dispersion, and photographic characteristics (e.g., development acceleration, contrast and sensitization) or preventing sticking.

Examples of useful surfactants include nonionic surfactants such as saponin (steroid), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, or polyethylene oxide adducts of silicone), glycidol derivatives (e.g., alkenylsuccinic acid polyglycerides or alkylphenol polyglycerides), and alkyl esters, for example, fatty acid esters of polyhydric alcohols; anionic surfactants having an acid group such as carboxyl group, sulfo group, phospho group, sulfuric ester group or phosphoric ester group such as alkylcarboxylates, alkylsulfonates, alkylbenzenesulfonates, alkylnaphthalenesulfonates, alkylsulfuric esters, alkylphosphoric esters., N-acyl-N-alkyltaurines, sulfosuccinic esters, sulfoalkylpolyoxyethylene alkylphenyl ethers and polyoxyethylene alkylphosphoric esters; ampholytic surfactants such as amino acids, aminoalkylsulfonic acids, aminoalkylsulfuric or phosphoric esters, alkylbetaines and amine oxides; and cationic surfactants such as alkylamine salts, aliphatic or aromatic quaternary ammonium salts, heterocyclic quaternary ammonium salts such as pyridinium salts and imidazolium salts and phosphonium or sulfonium salts having an aliphatic or heterocyclic ring.

Surfactants preferably used in the present invention are polyalkylene oxides having a molecular weight of not less than 600 described in JP-B-58-9412.

Further, polymer latexes such as polyalkyl acrylates can be used to improve dimensional stability.

Fluorine-containing surfactants described in JP-A-60-80849 are preferred to also impart antistatic properties.

Compounds described in JP-A-53-77616, JP-A-54-37732, JP-A-53-137133, JP-A-60-140340 and JP-A-60-14959 and various compounds having an N or S atom are effective as development accelerators or accelerators for nucleating infectious development in the present invention.

Non-limiting examples of such accelerators include the following compounds.

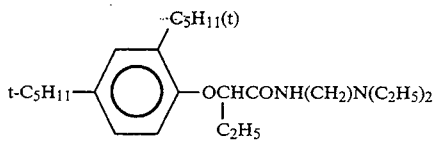

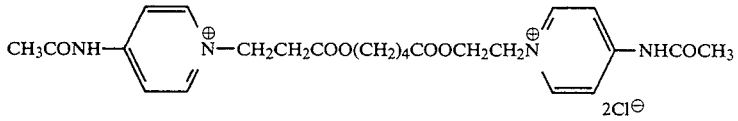

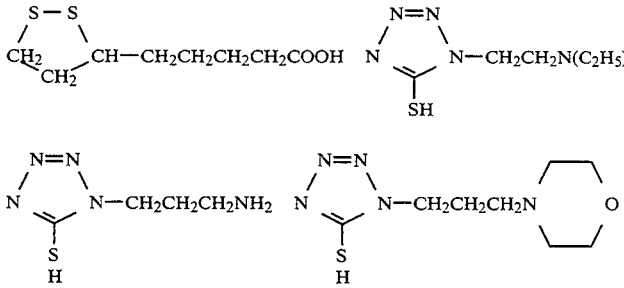

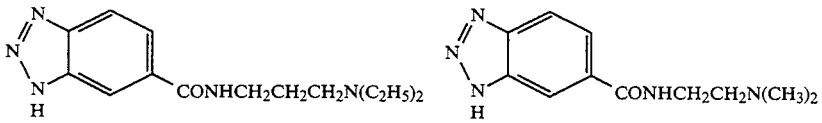

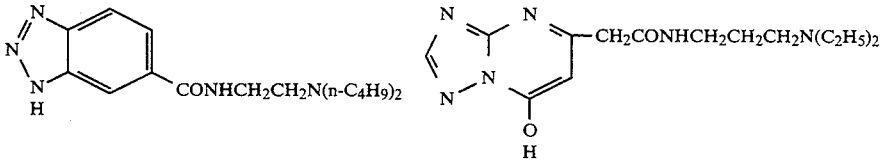

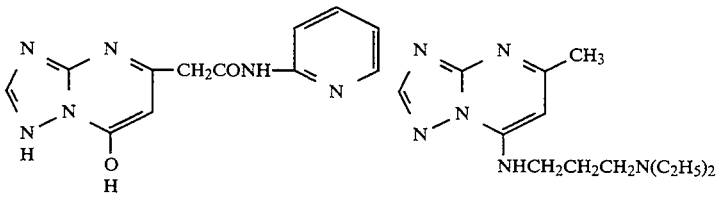

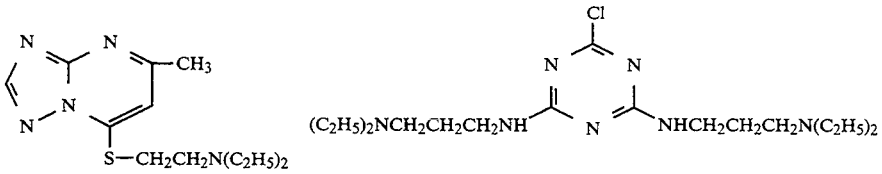

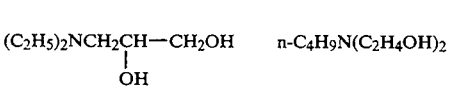

The amounts of these accelerators to be added vary depending on the specific type of accelerator chosen, but are generally in the range of $1.0\times10^{-3}$ to 0.5 g/m$^2$, preferably $5.0\times10^{-3}$ to 0.1 g/m$^2$. These accelerators are dissolved in appropriate solvents (e.g., $H_2O$, alcohols such as methanol and ethanol, acetone, dimethylformamide, or methyl cellosolve) and added to the coating solutions.

Two or more kinds of the above-described additives may be used in combination.

The photographic materials and other hydrophilic colloid layers of the photographic materials of the present invention may contain hydroquinone derivatives (called DIR hydroquinone) which release a restrainer in an amount corresponding to the density of image during development.

Examples of such hydroquinone derivatives include compounds described in U.S. Pat. Nos. 3,379,529, 3,620,746, 4,377,634 and 4,332,878, JP-A-49-129536, JP -A-54-67419, JP-A-56-153336, JP-A-56-153342, JP-A-59-278853, JP-A-59-90435, JP-A-59-90438 and JP-A-59-138808.

The photographic emulsion layers and other hydrophilic colloid layers of the photographic materials of the present invention may contain matting agents such as silica, magnesium oxide, and polymethyl methacrylate to prevent sticking of the formed materials.

The photographic materials of the present invention may contain the dispersions of water-insoluble or slightly water-soluble synthetic polymers to impart dimensional stability. Examples of such polymers include homopolymers of alkyl (meth)acrylates, alkoxyalkyl (meth)acrylates, and glycidyl (meth)acrylate; copolymers composed of a combination of these compounds; and copolymers of these compounds with monomers such as acrylic acid, or methacrylic acid.

It is preferred that the silver halide emulsion layers and other layers of the photographic materials of the present invention contain compounds having an acid group. Examples of such compounds include organic acids (such as salicylic acid, acetic acid, or ascorbic acid) and homopolymers or copolymers having a repeating unit derived from an acid monomer (such as acrylic acid, maleic acid, or phthalic acid). These compounds are described in JP-A-61-223834, JP-A-61-228437, JP-A-62-25745, and JP-A-62-55642. Among the low-molecular compounds, ascorbic acid is particularly preferred. Among the high-molecular compounds, water-dispersed latexes of copolymers of an acid monomer (such as acrylic acid with a crosslinking monomer having at least two unsaturated groups such as divinylbenzene) are particularly preferred.

The emulsions of the present invention are coated on an appropriate support such as glass, cellulose acetate film, polyethylene terephthalate film, paper, barayta paper, or polyolefin coated paper.

When the silver halide photographic materials of the present invention are used, ultra-high contrast photographic characteristics can be obtained by using stable developing solutions without using conventional infectious developing solutions or high-alkaline developing solutions having a pH of nearly 13 as described in U.S. Pat. No. 2,419,975.

Namely, when the silver halide photographic materials of the present invention are used, an ultra-high contrast negative image can be obtained using developing solutions containing a sulfite ion as a preservative in an amount of at least 0.15 mol/l and having a pH of 10.5 to 12.3, particularly 11.0 to 12.0.

There is no particular limitation with regard to developing agents which can be used in the present invention. For example, dihydroxybenzenes (e.g., hydroquinone), 3-pyrazolidones (e.g., 1-phenyl-3-pyrazolidone, or 4,5-dimethyl-1-phenyl-3-pyrazolidone), and aminophenols (e.g., N-methyl-p-aminophenol) can be used alone or in combination.

Though there is no particular limitation with regard to developing agents which are used in the developing solutions of the present invention, it is preferred from the viewpoint of obtaining halftone dots of good quality that the developing solutions contain dihydroxybenzenes. Combinations of dihydroxybenzenes with 1-phenyl-3-pyrazolidones or combinations of dihydroxybenzenes with p-aminophenols are preferred.

Examples of dihydroxybenzene developing agents useful in the present invention include hydroquinone, chlorohydroquinone, bromohydroquinone, isopropylhydroquinone, methylhyroquinone, 2,3-dichlorohydroquinone, 2,5-dichlorohydroquinone, 2,3-dibromohydroquinone, and 2,5-dimethylhydroquinone. Among these, hydroquinone is particularly preferred.

Examples of 1-phenyl-3-pyrazolidones and derivatives thereof useful as developing agents in the present invention include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-di -hydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of p-aminophenol developing agents useful in the present invention include N-methyl-p-aminophenol, p-aminophenol, N-(β-hydroxyethyl)-p-aminophenol, N-(4-hydroxyphenyl) glycine, 2-methyl-p-aminophenol, and p-benzylaminophenol. Among these, N-methyl-p-aminophenol is preferred.

Developing agents are preferably used in an amount of 0.05 to 0.8 mol/l. When a combination of dihydroxybenzene with 1-phenyl-3-pyrazolidone or p-aminophenol is used, it is preferred that the former is used in an amount of 0.05 to 0.5mol/l and the latter is used in an amount of not more than 0.06 mol/l.

The silver halide photographic materials of the present invention are particularly suitable for processing with developing solutions containing dihydroxybenzenes as developing agents and 3-pyrazolidones or aminophenols as auxiliary developing agents. It is preferred that the developing solutions contain dihydroxybenzenes in an amount of 0.05 to 0.5 mol/l and 3-pyrazolidones or aminophenols in an amount of not more than 0.06 mol/l.

Development rate can be increased and development time can be shortened by adding amines to the developing solutions as described in U.S. Pat. No. 4,269,929.

Further, the developing solutions contains pH buffering agents (such as alkali metal sulfites, carbonates, borates, and phosphates), restrainers or anti-fogging agents (such as bromides, or iodides) and organic anti-fogging agents (most preferably nitroindazoles or benztriazoles). If desired, the developing solutions may optionally contain a water softener, dissolution aid, a color toning agent, a development accelerator (most preferably the above-described polyalkylene oxides), an anti-foaming agent, a hardening agent, and a silver stain inhibitor (e.g., 2-mercapto-benzimidazolesulfonic acids).

Examples of sulfites used as preservatives in the present invention include sodium sulfite, potassium sulfite, lithium sulfite, ammonium sulfite, sodium bisulfite, potassium metabisulfite, and formaidehyde/sodium bisulfite. The sulfites are used in an amount of preferably at least 0.15 mol/l, most preferably at least 0.5 mol/l. The upper limit is preferably 2.5 mol/l.

Examples of alkali agents used for setting the pH include pH adjustors or buffering agents such as sodium hydroxide, potassium hydroxide, sodium carbonate, potassium carbonate, sodium tertiary phosphate, and potassium tertiary phosphate. The pH of the developing solutions is set to a value in the range of 10.5 to 12.3.

Examples of additives which can be used in addition to the above-described ingredients include compounds such as boric acid and borax, restrainers (such as sodium bromide, potassium bromide and potassium iodide); organic solvents (such as ethylene glycol, diethylene glycol, triethylene glycol, dimethylformamide, methyl cellosolve, hexylene glycol, ethanol, and methanol); and black pepper inhibitors or anti-fogging agents (such as 1-phenyl-5-mercaptotetrazole, indazole compounds (e.g., 5-nitroindazole) and benztriazole compounds (e.g., 5-methylbenztriazole)). If desired, further color toning agent, surfactant, anti-foaming agent, water softener, hardening agent, or amino compounds (described in JP-A-56-106244) may also be added.

The developing solutions of the present invention may contain silver stain inhibitors, such as described in JP-A-56-24347. Compounds described in JP -A-61-267759 can be used as dissolution aids to be added to the developing solutions. Further, the compounds described in JP-A-60-93433 or JP-A-62-186259 can be used as pH buffering agents in the developing solutions.

Conventional fixing agents can be used. Examples of such fixing agents include thiosulfates, thiocyanates, and organosulfur compounds known to have a fixing effect as fixing agent. Fixing solutions may contain water-soluble aluminum salts (e.g., aluminum sulfate, or alum) as hardening agents. Water-soluble aluminum salts are generally used in an amount of 0.4 to 2.0 g-Al/l. Further, iron (III) compounds can be used as a complex with water soluble atuminium salts and with ethylenediaminetetraacetic acid as an oxidizing agent.

Development is generally carried out at a temperature of 18° to 50° C., preferably 25° to 43° C.

It is preferred that photographic processing is carried out using automatic processors. Even when the total processing time, measured from when the photographic material enters the automatic processor until when it leaves, is from 90 to 120 seconds, it is still possible to obtain photographic characteristics having sufficient ultra-high contrast negative gradation.

The present invention is now illustrated in greater detail by reference to the following nonlimiting examples.

EXAMPLE 1

Preparation of Sensitive Emulsion

To an aqueous gelatin solution kept at 50° C. were simultaneously .added an aqueous solution of silver nitrate and an aqueous solution of potassium iodide and potassium bromide in the presence of $4\times10^{-7}$ mol of potassium iridium (III) hexachloride per mol of silver and ammonia over a period of 60 minutes while keeping the pAg at 7.8 to prepare a cubic monodisperse emulsion having a mean grain size of 0.28 $\mu$ and an average silver iodide content of 0.3 mol %. The emulsion was desalted by the flocculation method. After 40 g of inactive gelatin per mol of silver was added, the emulsion was kept at 50° C. and 5,5'-dichloro-9-ethyl-3,3'-bis-(3-sulfopropyl)oxacarbocyanine as a sensitizing dye and $10^{-3}$ mol (per mol of silver) of KI solution were added. The emulsion was left to stand for 15 minutes, and the temperature was elevated.

Coating of Sensitive Emulsion

The emulsion was re-dissolved. To the resulting solution at 40° C. was added the following hydrazine derivatives ($7.1\times10^{-5}$ mol/m$^2$).

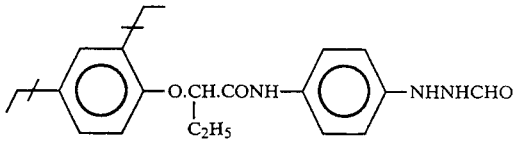

Methylhydroquinone (0.02 mol/mol of Ag), 5-methylbenztriazole, 4-hydroxy-1,3,3a,7-tetraazaindene, the following compounds (a) and (b), compound (LI)-3, (LII)-5, or (LII)-6 ($5\times10^{-6}$ mol/m$^2$) of the present invention, or the following compound (d) ($5\times10^{-6}$ mol/m$^2$) as comparative compound, 30 wt % (based on the amount of gelatin) of polyethyl acrylate and the following compound (c) as a hardening agent were added. The emulsion was coated on a polyethylene terephthalate film (150 $\mu$) having an undercoat layer (0.5 $\mu$) composed of a vinylidene chloride copolymer in such an amount as to give a coating weight of 3.4 g/m$^2$ in terms of silver.

(a)

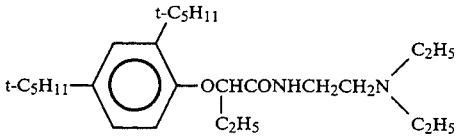

3.5 mg/m$^2$ (b)

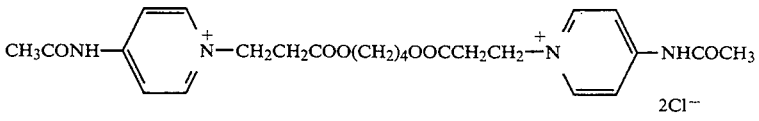

15.0 mg/m$^2$ (c)

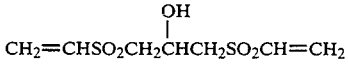

2.0 wt % based on the amount of gelatin

-continued (d)

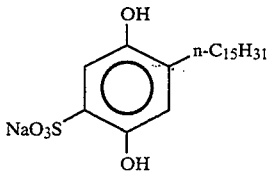

Coating of Protective Layer

A protective layer containing gelatin (1.5 g/m$^2$) and polymethyl methacrylate particles (average particle size: 2.5 μ, coating weight: 0.3 g/m$^2$) was coated on the emulsion using the following surfactants.

Surfactant

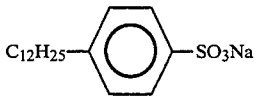

37 mg/m$^2$ $CH_2COOC_6H_{13}$
|
$CHCOOC_6H_{13}$ 37 mg/m$^2$
|
$SO_3Na$ $C_8F_{17}SO_2N(C_3H_7)CH_2COOK$ 2.5 mg/m$^2$

These samples were exposed to tungsten light (3200° K.) through an optical wedge and a contact screen (150 L chain dot type, manufactured by Fuji Photo Film Co., Ltd.), developed with the following developing solution at 34° C. for 39 seconds, fixed, rinsed, and dried.

The halftone gradation of the resulting samples was measured. The results are shown in Table 1. Halftone gradation is represented by the following formula.

Halftone gradation = (exposure amount giving 95% dot percent (logE 95%)) — (exposure amount giving 5% dot percent (logE 5%))

| Developing Solution | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |

-continued

| Developing Solution | |
|---|---|
| 5-Methylbenztriazole | 0.4 g |
| 2-Mercaptobenzimidazole-2-sulfonic acid | 0.3 g |
| Sodium 3-(5-mercaptotetrazole)-benzenesulfonate | 0.2 g |
| N-n-butyldiethanolamine | 15.0 g |
| Sodium toluenesulfonate | 8.0 g |
| Add water | to make 1 liter |
| pH (adjusted with potassium hydroxide) | 11.6 |

The halftone gradation of the samples of the present invention was widened in comparison with that of Comparative Examples. With regard to halftone form, the samples of the present invention had a smooth form, and the halftone dots of the samples of the present invention had a high optical density. Further, the samples of the present invention had improved properties with regard to the problem of black peppers.

TABLE 1

| | | Hydroquinone Derivative | | Photographic Characteristics | | | |
|---|---|---|---|---|---|---|---|
| No. | Sample | Type | Amount Added (mol/m$^2$) | $\overline{G}$*** | Halftone Gradation | Dmax* | Black Pepper** |
| 1 | Comp. Ex. 1-1 | — | — | 14.0 | 1.22 | 5.1 | 28 |
| 2 | Comp. Ex. 1-2 | Comp. Compound (d) | $5 \times 10^{-6}$ | 13.5 | 1.24 | 5.0 | 26 |
| 3 | Invention 1-1 | (LI)-3 | " | 14.5 | 1.30 | 5.0 | 8 |
| 4 | Invention 1-2 | (LII)-5 | " | 15.0 | 1.31 | 5.0 | 7 |
| 5 | Invention 1-3 | (LII)-6 | " | 14.5 | 1.30 | 5.1 | 4 |

*Dmax: Density obtained using an exposure amount giving a density higher by ΔlogE = 0.4 than the density obtained using an exposure amount giving a density of 1.5.

**Black Pepper: A visual field having a diameter of 4 mm was magnified 25 times, and an evaluation made by counting the number of black peppers existing in the field through a microscope. A smaller numerical value means that black peppers are reduced.

*** $\overline{G}$: The G value is defined by the following formula.

$$\overline{G} = \frac{3.0 - 0.3}{(\log(\text{exposure amount giving a density of } 3.0)) - (\log(\text{exposure amount giving a density of } 0.3))}$$

EXAMPLE 2

The following layers in order were coated on a polyester film (thickness: 150 μ) support:

Preparation of Emulsion for Redox Compound-Containing Layer

An aqueous solution of 1.0M silver nitrate and an aqueous halide solution containing 0.3M potassium bromide, 0.74M sodium chloride and $3 \times 10^{-7}$ mol (per mol of silver) of $(NH_4)_3RhCl_6$ were added to an aqueous gelatin solution containing sodium chloride and 1,3-dimethyl-2-imidazolidinethione with stirring at 45° C. over a period of 30 minutes by means of the double jet process to obtain silver chlorobromide grains having a mean grain size of 0.28 μm and a silver .chloride content of 70 mol %. The grains were washed with water by the flocculation method. 40 g of gelatin was added thereto, the pH was adjusted to 6.5 and the pAg was adjusted to 7.5. Further, 5 mg of sodium thiosulfate and 8 mg of chloroauric acid were then added, each amount being per mol of silver. The mixture was heated at 60° C. for 60 minutes to carry out a chemical sensitization treatment. Further, 150 mg of 4-hydroxy-6-methyl-1,3,3a,7-tetraazaindene was added as a stabilizer. The resulting grains were cubic silver chlorobromide grains having a mean grain size of 0.28 μm and a silver chloride content of 70 mol % (a coefficient of variation: 10%).

The resulting emulsion was divided, and $1\times10^{-3}$ mol (per mol of silver) of 5-[3-(4-sulfobutyl)-5-chloro-2-oxazolidilidene]-1-hydroxyethyl-3-(2-pyridyl)-2-thiohydantoin as a sensitizing dye was added. Further, $2\times10^{-4}$ mol of 1-phenyl-5-mercaptotetrazole, a dispersion of polyethyl acrylate (50 mg/m$^2$), 1,2-bis(vinylsulfonylacetamido)ethane (40 mg/m$^2$), and the redox compound 3-9 ($4\times10^{-3}$ mol/mol of Ag) were added.

Coating of Sensitive Emulsion Layer

(1) Sensitive Emulsion Layer-A

The sensitive emulsion formulation of Example 1 was used, and the emulsion was coated in such an amount as to give a coating weight of 0.4 g/m$^2$ in terms of silver.

(2) Interlayer

Gelatin (0.5 g/m$^2$), polyethyl acrylate latex (0.15 g/m$^2$) and the compound (LI-3), (LII)-5, or (LII)-6 of the present invention or comparative compound (d) of Example 1 were coated on to the emulsion layer. The compound of the present invention or comparative compound (d) were used at a coating weight of $5\times10^{-5}$ mol/m$^2$.

(3) Sensitive Emulsion Layer-B

The sensitive emulsion (containing the hydrazine derivative) of Example 1 was coated in such an amount as to give a coating weight of 3.4 g/m$^2$.

(4) Protective Layer

According to the formulation of Example 1, coating was carried out to give a gelatin coating weight of 1.0 g/m$^2$.

The results are shown in Table 2.

TABLE 2

| | | Hydroquinone Derivative | | Photographic Characteristics | | | |
|---|---|---|---|---|---|---|---|
| No. | Sample | Type | Amount Added (mol/m$^2$) | Halftone Gradation | Quality of Halftone Dot | Dmax | Black Pepper |
| 1 | Comp. Ex. 1-1 | — | — | 1.34 | 3 | 4.8 | 18 |
| 2 | Comp. Ex. 1-2 | Comp. Compound (d) | $5\times10^{-5}$ | 1.35 | 4 | 4.2 | 15 |
| 3 | Invention 1-1 | (LI)-3 | " | 1.41 | 4.5 | 4.7 | 6 |
| 4 | Invention 1-2 | (LII)-5 | " | 1.42 | 4.5 | 4.8 | 4 |
| 5 | Invention 1-3 | (LII)-6 | " | 1.42 | 4.5 | 4.7 | 5 |

The evaluation of halftone dot quality was visually based on five grades. In the five grade evaluation, the grade of 5 indicates the best quality and the grade of 1 indicates the worst quality. In a halftone original plate for plate making, the grades of 5 and 4 are practically usable, the grade of 3 is at the limit of practically usability, and grades of 2 and 1 indicates quality which is practically unusable.

As shown in Table 2, the samples of the present invention have halftone dots of high quality and give halftone images having wide halftone gradation. Further, the samples of the present invention have a high D max and the formation of black peppers is low.

In the following Examples 3 to 5, the following developing solution was used.

| Formulation of Developing Solution | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenztriazole | 0.4 g |
| 2-Mercaptobenzimidazole-2-sulfonic acid | 0.3 g |
| Sodium 3-(5-mercaptotetrazole)-benzenesulfonate | 0.2 g |
| N-n-Butyldiethanolamine | 15.0 g |
| Sodium toluenesulfonate | 8.0 g |
| Add water | 1 liter |
| pH (adjusted with potassium hydroxide) | 11.6 |

EXAMPLE 3

Emulsion A

An aqueous solution of 0.13M silver nitrate and an aqueous halide solution containing 0.04M potassium bromide, 0.09M sodium chloride, $1\times10^{-7}$ mol (per mol of silver) of $(NH_4)_3RhCl_6$ and $2\times10^{-7}$ mol (per mol of silver) of $K_3IrCl_6$ were added to an aqueous gelatin solution containing sodium chloride and 1,2-dimethyl-2-imidazolidinethione with stirring .at 38° C. over a period of 12 minutes by means of the double jet process to obtain silver chlorobromide grains having a mean grain size of 0.15 μm and a silver chloride content of 70 mol %, thus effecting nucleation. Subsequently, an aqueous solution of 0.87M silver nitrate and an aqueous halide solution containing 0.26M potassium bromide and 0.65M sodium chloride were added thereto over a period of 20 minutes by means of the double jet process.

Thereafter, $1\times10^{-3}$ mol of KI solution was added to this solution, and conversion was made. The mixture was washed with water by the flocculation method. 40 g of gelatin was added, pH was adjusted to 6.5, and pAg was adjusted to 7.5. Further, 5 mg of sodium thiosulfate and 8 mg of chloroauric acid were added, each amount being per mol of silver. The mixture was heated at 60° C. for 60 minutes to carry out a chemical sensitization treatment, and 150 mg of 1,3,3a,7-tetraazaindene as a stabilizer was added.. The resulting grains were cubic silver chlorobromide grains having a mean grain size of 0.27 μm and a silver chloride content of 70 mol % (coefficient of variation: 10%).

Emulsion B

An aqueous solution of 0.13M silver nitrate and an aqueous halide solution containing 0.052M potassium bromide, 0.078M sodium chloride, and $1\times10^{-7}$ mol (per mol of silver) of $(NH_4)_3RhCl_6$ and $2\times10^{-7}$ mol (per mol of silver) of $K_3IrCl_6$ were added to an aqueous gelatin solution containing sodium chloride and 1,3-dimethyl-2-imidazolidinethione with stirring at 45° C.

for 12 minutes by means of the double jet process to obtain silver chlorobromide grains having a mean grain size of 0.15 μm and a silver chloride content of 60 mol %, thus effecting nucleation. Subsequently, an aqueous solution of 0.87M silver nitrate and an aqueous halide solution containing 0.34M potassium bromide and 0.52M sodium chloride were added thereto over a period of 20 minutes by means of the double jet process.

Thereafter, $1\times10^{-3}$ mol of KI solution was added thereto to make conversion, and the mixture was washed with water by the flocculation method. 40 g of gelatin was added, the pH adjusted to 6.5, and the pAg was adjusted to 7.5. Further, 5 mg of sodium thiosulfate and 8 mg of chloroauric acid were added thereto, each amount being per mol of silver. The mixture was heated at 60° C. for 60 minutes to carry out a chemical sensitization treatment. Further, 150 mg of 1,3,3a,7-tetraazaindene as a stabilizer was added.. The resulting grains were cubic silver chlorobromide grains having a mean grain size of 0.27 μm and a silver ,chloride content of 60 mol % (coefficient of variation: 10%).

Emulsion C

An aqueous solution of 0.13M silver nitrate and an aqueous halide solution containing 0..078M potassium bromide, 0.052M sodium chloride, and $1\times10^{-7}$ mol (per mol of silver) of $(NH_4)_3RhCl_6$ and $2\times10^{-7}$ mol (per mol of silver) of $K_3IrCl_{16}$ were added to an aqueous gelatin solution containing sodium chloride with stirring at 45° C. over a period of 12 minutes by means of the double jet process to obtain silver chlorobromide grains having a mean grain size of 0.15 μm and a silver chloride content of 70 mol %, thus effecting nucleation. Subsequently, an aqueous solution of 0.87M silver nitrate and an aqueous halide solution containing 0.522M potassium bromide and 0.348M sodium chloride were added thereto over a period of 20 minutes by means of the double jet process.

Thereafter, $1\times10^{-3}$ mol of KI solution was added thereto to make conversion. The mixture was washed with water by the flocculation method. 40 g of gelatin was added, the pH was adjusted to 6.5, and the pAg adjusted to 7.5. Further, 5 mg of sodium thiosulfate and 8 mg of chloroauric acid were added, each amount being per mol of silver. The mixture was heated at 60° C. for 60 minutes to carry out a chemical sensitization treatment. Further, 150 mg of 4-hydroxy-6-methyl-1,3,3a,7-tetraazaindene as a stabilizer was added. The resulting grains were cubic silver chlorobromide grains having a mean grain size of 0.27 μm and a silver chloride content of 40 mol % (coefficient of variation: 11%).

Emulsions A, B, and C were each divided, and $1\times10^{-3}$ mol (per mol of silver) of 5-[3-(4-sulfobutyl)-5-chloro-2-oxazolidilidene]-l-hydroxyethyl-3-(2-pyridyl)-2-thiohydantoin added as a sensitizing dye. Further, $2\times10^{-4}$ mol of 1-phenyl-5-mercaptottetrazole, $5\times10^{-4}$ mol of short-wave cyanine dye represented by the following structural formula (a), latex (200 mg/m²) of a water-soluble polymer represented by the following formula (b), a dye (50 mg/m²) represented by the following formula (c), a dispersion of polyethyl acrylate (200 mg/m²), 1,3-divinylsulfonyl-2-propanol (200 mg/m²), the hydrazine compounds I-7 ($1\times10^{-4}$ mol/mol of Ag) and 1-19 ($1\times10^{-6}$ mol/mol of Ag) of the present invention were added.

(a)

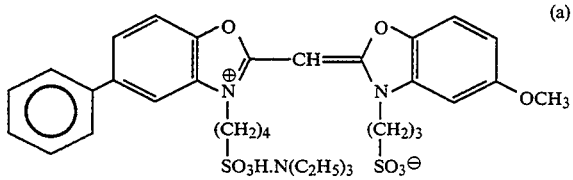

(b)

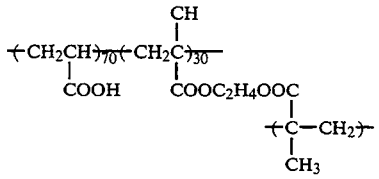

(c)

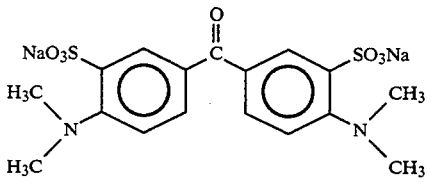

The hydrazine-containing layer as the lowermost layer (3.6 g of Ag/m², 2 g of gelation/m²) and a protective layer thereon, were coated simultaneously on the sensitive emulsion layer. The protective layer contained the hydroquinone derivative (LI) or (LII) (indicated in Table 3) of the present invention, gelatin (1.0 g/m²), amorphous $SiO_2$matting agent having a particle size of about 3.5 μ (40 mg/m²), methanol silica (0.1 g/m²), polyacrylamide (100 mg/m²), hydroquinone (200 mg/m²), silicone oil, a fluorine-containing surfactant represented by the following structural formula

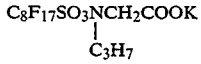

and sodium dodecylbenzenesulfate as coating aids. In this way, samples given in Table 3 were prepared. Evaluation of the results are also shown in Table 3.

A back layer and a protective layer for the back layer were coated on the support using the following formulations.

| Back Layer | |
|---|---|
| Gelatin | 3 g/m² |
| Latex of polyethyl acrylate | 2 g/m² |
| Surfactant (sodium p-dodecyl-benzene sulfonate | 40 mg/m² |
| Hardening agent for gelatin | 110 mg/m² |

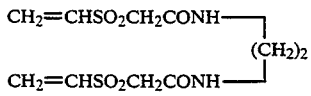

Dye: a mixture of Dyes (a), (b), and (c)

-continued

| | |
|---|---|
| dye (a) | 50 mg/m$^2$ |
| dye (b) | 100 mg/m$^2$ |
| dye (c) | 50 mg/m$^2$ |
| Protective Layer for Back Layer | |
| Gelatin | 0.8 mg/m$^2$ |
| Fine particles of polymethyl methacrylate (average particle size: 4.5μ) | 30 mg/m$^2$ |
| Sodium dihexyl α-sulfosuccinate | 15 mg/m$^2$ |
| Sodium dodecylbenzenesulfonate | 15 mg/m$^2$ |
| Fluorine-containing surfactant | 5 mg/m$^2$ |

$$C_8F_{17}SO_2N(C_3H_7)-CH_2COOK$$

| | |
|---|---|
| Sodium acetate | 40 mg/m$^2$ |

Dye (a)

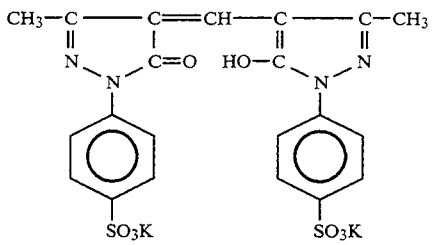

Dye (b)

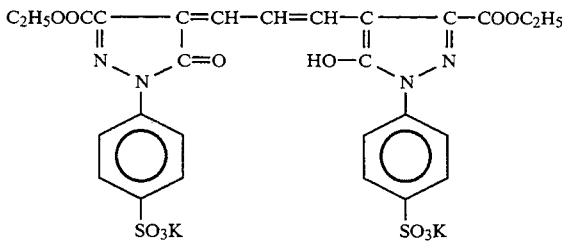

Dye (c)

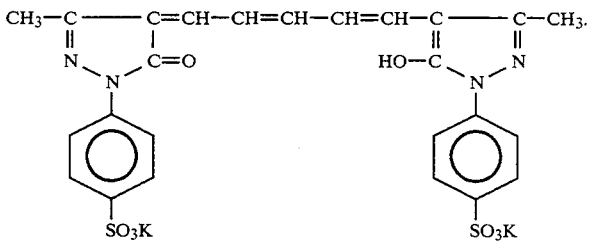

It is apparent from Table 3 that Samples 2 to 5, 9 to 12, and 16 to 19 (especially Samples 2 to 5, and 9 to 12) of the present invention, are superior in photographic characteristics 1 and 2 as well as having significantly reduced black peppers.

Evaluation was made using the following test methods.

Photographic Characteristics

Photographic characteristics 1 are the results obtained by carrying out processing at 34° C. for 30 seconds using the aforesaid developing solution and an automatic processor (FG-660F manufactured by Fuji Photo Film Co., Ltd.).

The fixing solution used was GR-F1.

Photographic characteristics 2 are the results obtained by carrying out processing in the same manner as photographic characteristics 1 using developing solution obtained from processing 150 sheets of Fuji lith ortho-film GA-100 (50.8 cm×61 cm size) having 100% of area blackened.

The reciprocal of exposure amount giving a density of 1.5 in the above 34° C.—30 sec development is referred to herein as "sensitivity". The sensitivity of the sample 1 is referred to as 100. The sensitivity in terms of relative sensitivity is shown in Table 3.

The γ (gamma) value is defined by the following formula.

$$\gamma = \frac{3.0 - 0.3}{\log(\text{exposure amount giving a density of } 3.0) - \log(\text{exposure amount giving a density of } 0.3)}$$

The evaluation of black pepper was made in 5 grades by observing a part of the developed material through a microscope. This part was a ground area that appeared when the 34° C.—40sec development was conducted. The grade of 5 indicates the best quality, and the grade of 1 indicates the worst quality. Material having a grade of 5 or 4 is practically usable. The grade of 3 is inferior, but usable with difficulty. Material having a grade of 2 or 1 is practically unusable. The grade between 4 and 3 is evaluated as 3.5.

TABLE 3

| Sample No. | Emulsion | Compound of Formula (LI) or (LII) Compound | Amount Added (mol/mol of Ag) | Photographic Characteristics 1 Sensitivity | γ | Dmax | Photographic Characteristics 2 Sensitivity | γ | Dmax | Black Pepper |
|---|---|---|---|---|---|---|---|---|---|---|
| 1 | A | — | — | 100 | 18 | 5.5 | 89 | 15.2 | 5.0 | 1 |
| 2* | " | (LI)-3 | $2 \times 10^{-3}$ | 100 | 19.6 | 5.5 | 95 | 17.6 | 5.3 | 4 |
| 3* | " | " | $4 \times 10^{-3}$ | 102 | 20 | 5.6 | 98 | 17.8 | 5.3 | 5 |
| 4* | " | (LII)-5 | $2 \times 10^{-3}$ | 100 | 19.2 | 5.5 | 95 | 17.2 | 5.3 | 4 |
| 5* | " | " | $4 \times 10^{-3}$ | 100 | 20.6 | 5.6 | 95 | 18.0 | 5.4 | 5 |
| 6 | " | Comp. Compound (a) | $2 \times 10^{-3}$ | 100 | 17.8 | 5.4 | 89 | 15.0 | 5.0 | 2 |
| 7 | " | Comp. Compound (a) | $4 \times 10^{-3}$ | 100 | 17.6 | 5.4 | 89 | 14.8 | 5.0 | 2 |
| 8 | B | — | — | 105 | 17.8 | 5.5 | 91 | 15.0 | 4.9 | 1 |
| 9* | " | (LI)-3 | $2 \times 10^{-3}$ | 107 | 18.5 | 5.5 | 97 | 16.8 | 5.3 | 4 |
| 10* | " | " | $4 \times 10^{-3}$ | 107 | 18.3 | 5.5 | 97 | 16.9 | 5.3 | 5 |
| 11* | " | (LII)-5 | $2 \times 10^{-3}$ | 107 | 19.0 | 5.5 | 95 | 16.9 | 5.4 | 4 |
| 12* | " | " | $4 \times 10^{-3}$ | 110 | 19.6 | 5.6 | 97 | 17.0 | 5.4 | 5 |
| 13 | B | Comp. Compound (a) | $2 \times 10^{-3}$ | 105 | 17.8 | 5.5 | 87 | 14.0 | 4.9 | 1 |
| 14 | " | Comp. Compound (a) | $4 \times 10^{-3}$ | 105 | 17.4 | 5.4 | 87 | 14.2 | 4.9 | 2 |
| 15 | C | — | — | 102 | 17.6 | 5.3 | 81 | 14.4 | 4.7 | 1 |
| 16* | " | (LI)-3 | $2 \times 10^{-3}$ | 102 | 17.0 | 5.3 | 87 | 15.0 | 4.8 | 3 |
| 17* | " | " | $4 \times 10^{-3}$ | 102 | 17.0 | 5.2 | 87 | 14.8 | 4.7 | 4 |
| 18* | " | (LII)-5 | $2 \times 10^{-3}$ | 100 | 17.2 | 5.3 | 85 | 14.6 | 4.7 | 3 |
| 19* | " | " | $4 \times 10^{-3}$ | 98 | 16.8 | 5.1 | 81 | 14.0 | 4.5 | 4 |
| 20 | " | Comp. Compound (a) | $2 \times 10^{-3}$ | 102 | 17.4 | 5.2 | 81 | 13.2 | 4.3 | 1 |
| 21 | | Comp. Compound (a) | $4 \times 10^{-3}$ | 100 | 17.0 | 5.1 | 81 | 13.2 | 4.4 | 1 |

*Invention

Comparative Compound (a)

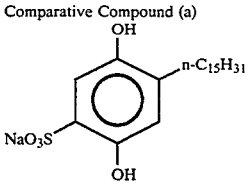

EXAMPLE 4

Preparation of Emulsion for The Redox Compound Containing Layer

An aqueous solution of 1.0M silver nitrate and an aqueous halidie solution containing 0.3M potassium bromide, 0.74M sodium chloride, and $3 \times 10^{-7}$ mol (per mol of silver) of $(NH_4)_3RhCl_6$ were added to an aqueous gelatin solution containing sodium chloride and 1,3-dimethyl-2-imidazolidinethione with stirring at 45° C. over a period of 30 minutes by means of the double jet process to obtain silver chlorobromide grains having a mean grain size of 0.28 μm and a silver chloride content of 70 mol %. The grains were washed with water by the flocculation method. 40 g of gelatin was added, the pH adjusted to 6.5 and the pAg adjusted to 7.5. Further, 5 mg of sodium thiosulfate and 8 mg of chloroauric acid were added, each amount being per mol of silver. The mixture was heated to 60° C. for 60 minutes to carry out a chemical sensitization treatment. Further, 150 mg of 4-hydroxy-6-methyl-1,3,3a,7-tetraazaindene were added as a stabilizer. The resulting grains were cubic silver chlorobromide grains having a mean grain size of 0.28 μm and a silver chloride content of 70 mol % (coefficient of variation: 10%).

The emulsion was divided, and $1 \times 10^{-3}$ mol (per mol of silver) of 5-[3-(4-sulfobutyl)-5-chloro-2-oxazolidilidene ]-1-hydroxyethyl-3-(2-pyridyl)-2-thiohydantoin as a sensitizing dye added. Further, $2 \times 10^{-4}$ mol of 1-phenyl-5-mercaptotetrazole, a dispersion of polyethyl acrylate (50 mg/m²), 1,2-bisacrylate (vinylsulfonylacetamido)ethane (40 mg/m²), and the redox compound of present invention indicated in Table 4 were added.

Simultaneously coated were the hydrazine-containing layer of Example 3 (obtained by adding the additives to the emulsion (A), (B) or (C) as described in Example 3) as the lowermost layer, a redox-containing layer (Ag: 0.4 g/m², gelatin: 0.5 g/m²) through an interlayer (containing the hydroquinone derivative (LI) or (LII) of the present invention, gelatin: 0.5 g/m²) and further a protective layer (containing gelatin (1.0 g/m²), amorphous $SiO_2$matting agent having a particle size of about 3.5 μ (40 mg/m²) methanol silica (0.1 g/m²), polyacrylamide (100 mg/m²), hydroquinone (200 mg/m²), silicone oil, a fluorine-containing surfactant represented by the following structural formula

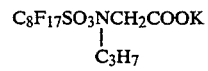

and sodium dodecylbenzenesulfonate as coating aids). In this way, the samples described in Table 4 were prepared. An evaluation of the results are shown in Table 4.

The back layer and the protective layer for the back layer were coated on the support using the same formulations as described in Example 3.

Evaluation of Quality of Line Work

The original, comprising 7 grade of Mincho type and Gothic type phototypeset letters having a reflection density in the range of 0.5 to 1.2, was photographed using a DSC 351 camera (a product of Dainippon Screen KK). Development: (34° C., 30") was carried out under the same conditions as used for the measurement of the photographic characteristics. Evaluation was made using the five grades described above. Grade 5 indicates the best quality, and a grade of 1 indicates the worst quality. A grade of 5 or 4 means the material is practically usable. A grade of 3 is inferior, but usable with difficulty, and a grade of 2 or 1 is practically unusable.

-continued

| Developing Solution A | |
|---|---|
| pH was adjusted with potassium hydroxide to | 11.7 |

While the invention has been described in detail and with reference to specific embodiments, it will be apparent to one skilled in the art that various changes and modifications can be made in these embodiments without departing from the spirit and scope of the invention.

TABLE 4

| Sample No. | Emulsion | Compound of Formula (LI) or (LII) Compound | Amount Added (mol/mol of Ag) | Redox Compound Compound | Amount Added (mol/mol of Ag) | Photographic Characteristics 1 Sensitivity | γ | Dmax | Photographic Characteristics 2 Sensitivity | γ | Dmax | Black Pepper | Quality of line work |
|---|---|---|---|---|---|---|---|---|---|---|---|---|---|
| 22 | A | (LI)-3 | $2 \times 10^{-3}$ | — | — | 100 | 19.6 | 5.5 | 95 | 17.6 | 5.3 | 4 | 1 |
| 23 | " | " | " | III-9 | $2 \times 10^{-3}$ | 89 | 16.0 | 5.4 | 83 | 15.0 | 5.0 | 5 | 5 |
| 24 | " | " | $4 \times 10^{-3}$ | " | " | 87 | 16.0 | 5.4 | 81 | 14.8 | 5.0 | 5 | 4 |
| 25 | " | (LII)-6 | $2 \times 10^{-3}$ | — | — | 102 | 20 | 5.5 | 98 | 18.0 | 5.4 | 4 | 1 |
| 26 | " | " | " | III-11 | $5 \times 10^{-4}$ | 89 | 15.8 | 5.4 | 81 | 14.0 | 5.3 | 5 | 5 |
| 27 | " | " | $4 \times 10^{-3}$ | " | " | 87 | 15.6 | 5.3 | 79 | 14.0 | 5.2 | 5 | 4 |
| 28 | B | (LI)-3 | $2 \times 10^{-3}$ | — | — | 107 | 18.5 | 5.5 | 97 | 16.8 | 5.3 | 4 | 1 |
| 29 | " | " | " | III-9 | $2 \times 10^{-3}$ | 91 | 15.8 | 5.3 | 81 | 14.0 | 5.0 | 5 | 5 |
| 30 | " | " | $4 \times 10^{-3}$ | " | " | 89 | 15.6 | 5.3 | 81 | 13.8 | 5.0 | 5 | 5 |
| 31 | " | (LII)-6 | $2 \times 10^{-3}$ | — | — | 107 | 18.7 | 5.5 | 95 | 16.4 | 5.2 | 4 | 1 |
| 32 | " | " | " | III-11 | $5 \times 10^{-4}$ | 89 | 15.8 | 5.4 | 79 | 14.0 | 5.0 | 5 | 5 |
| 33 | " | " | $4 \times 10^{-3}$ | " | " | 87 | 15.0 | 5.3 | 79 | 14.1 | 4.9 | 5 | 5 |
| 34 | C | (LI)-3 | $2 \times 10^{-3}$ | — | — | 102 | 17.0 | 5.3 | 87 | 15.0 | 4.8 | 3 | 1 |
| 35 | " | " | " | III-9 | $2 \times 10^{-3}$ | 81 | 13.8 | 4.7 | 69 | 10.8 | 4.2 | 5 | 3 |
| 36 | " | " | $4 \times 10^{-3}$ | " | " | 83 | 14.0 | 4.7 | 71 | 10.9 | 4.2 | 5 | 3 |
| 37 | " | (LII)-6 | $2 \times 10^{-3}$ | — | — | 105 | 17.8 | 5.4 | 87 | 15.2 | 5.0 | 3 | 1 |
| 38 | " | " | " | III-11 | $5 \times 10^{-4}$ | 83 | 13.9 | 4.8 | 71 | 10.2 | 4.2 | 5 | 3 |
| 39 | " | " | $4 \times 10^{-3}$ | " | " | 79 | 13.8 | 4.7 | 69 | 10.6 | 4.2 | 5 | 3 |

It is apparent from Table 4 that especially, Samples 22 to 33 have good photographic characteristics 1 and 2 and exhibit a significant reduction in black peppers, and Samples 23, 24, 26, 27, 29, 30 32 and 33 exhibit good line work quality.

EXAMPLE 5

The procedure of Example 4 was repeated except that a combination of hydrazine derivatives 1-13 and I-8 or a combination of the hydrazine derivatives 1-20 and I-21 was used in place of the combination of hydrazine derivatives I-7 and 1-19. There were obtained good results.

EXAMPLE 6

The procedure of Examples 3 to 5 was repeated except that each sample was processed with the following developing solution A. Similar results could be obtained.

| Developing Solution A | |
|---|---|
| Hydroquinone | 50.0 g |
| N-Methyl-p-aminophenol | 0.3 g |
| Sodium hydroxide | 18.0 g |
| 5-Sulfosalicylic acid | 30.0 g |
| Boric acid | 20.0 g |
| Potassium sulfite | 110.0 g |
| Disodium ethylenediaminetetraacetate | 1.0 g |
| Potassium bromide | 10.0 g |
| 5-Methylbenztriazole | 0.4 g |
| 2-Mercaptobenzimidazole-5-sulfonic acid | 0.3 g |
| Sodium 3-(5-mercaptotetrazole)-benzenesulfonate | 0.2 g |
| 6-Dimethylamino-1-hexanol | 4.0 g |
| Sodium toluenesulfonate | 15.0 g |
| Add water | to make 1 liter |

What is claimed is:

1. A method for developing an imagewise exposed black-and-white silver halide photographic material which comprises:

at least one silver halide emulsion layer;

a hydrazine derivative; and at least one hydroquinone derivative represented by general formula (LI) or (LII):

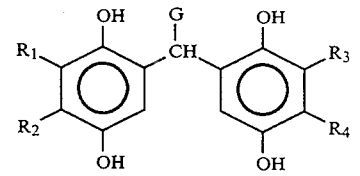

(LI)

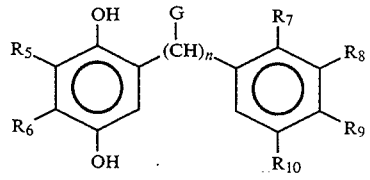

(LII)

wherein

G represents a hydrogen atom or an alkyl group having 1 to 17 carbon atoms;

n represents an integer of 1 to 5; and $R_1$ to $R_{10}$ each represent a hydrogen atom, an alkyl group , an aryl group, a hydroxyl group, an alkoxy group, an aryloxy group, a halogen atom, a primary, secondary or tertiary amino group, a carbonamido group, a sulfonamido group, a carbamoyl group, a sulfamoyl group, an alkylthio group, an arylthio group, an alkylsulfonyl group, an arylsulfonyl group, a carboxyl group or a sulfo group, said method comprising the step of processing the silver halide photographic material with a developing solution containing a dihydroxybenzene to form a negative image.

2. The method for developing a silver halide photographic material of claim 1, wherein the dihydroxybenzene in the developer is present in the amount of 0.05 to 0.8 mol/l.

3. The method for developing a silver halide photographic material of claim 1, wherein the developer further comprises a 1-phenyl-3-pyrazolidone.

4. The method for developing a silver halide photographic material of claim 1, wherein the developer further comprises a p-aminophenol.

5. A method for developing an imagewise exposed black-and-white silver halide photographic material which comprises a support having thereon at least one silver halide emulsion layer and at least one hydrophilic colloid layer, wherein at least one of said silver halide emulsion layer or said hydrophilic colloid layer contains a hydrazine derivative and at least one of said silver halide emulsion layer or said hydrophilic colloid layer contains at least one hydroquinone derivative represented by general formula (LI) or (LII):

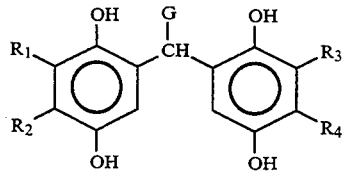

(LI)

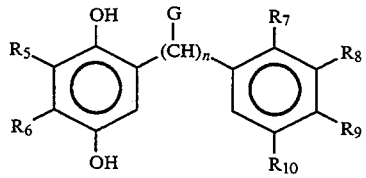

(LII)

wherein

G represents a hydrogen atom for an alkyl group having 1 to 17 carbon atoms;

n represents an integer of 1 to 5; and $R_1$ to $R_{10}$ each represents a hydrogen atom, an alkyl group, an aryl group, a hydroxyl group, an alkoxy group, an aryloxy group, a halogen atom, a primary, secondary or tertiary amino group, a carbonamido group, a sulfonamido group, a carbamoyl group, a sulfamoyl group, an alkylthio group, an arylthio group, an alkylsulfonyl group, an arylsulfonyl group, a carboxyl group or a sulfo group, said method comprising the step of processing the silver halide photographic material with a developing solution containing a dihydroxybenzene to form a negative image.

6. The method for developing silver halide photographic material as in claim 5, wherein said at least one silver halide emulsion layer has silver chloride content of at least 50 mol %.

7. The method for developing silver halide photographic material as in claim 6, wherein said at least one silver halide emulsion layer or said at least one hydrophilic colloid layer contains a redox compound which release a restrainer by oxidation.

8. A method for developing an imagewise exposed black-and-white silver halide photographic material which comprises:

at least one silver halide emulsion layer containing a hydrazine derivative;

at least one hydrophilic colloid layer which is adjacent to said at least one silver halide emulsion layer containing a hydrazine derivative; and at least one hydroquinone derivative represented by general formula (LI) or (LII):

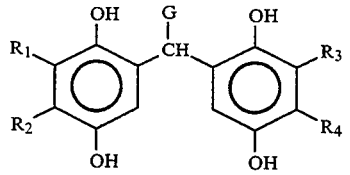

(LI)

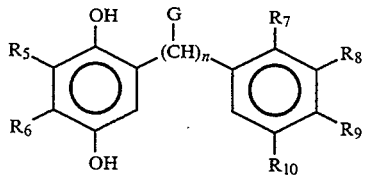

(LII)

G represents a hydrogen atom or an alkyl group having 1 to 17 carbon atoms;

n represents an integer of 1 to 5; and $R_1$ to $R_{10}$ each represent a hydrogen atom, an alkyl group, an aryl group, a hydroxyl group, an alkoxy group, an aryloxy group, a halogen atom, a primary, secondary or tertiary amino group, a carbonamido group, a sulfonamido group, a carbamoyl group, a sulfamoyl group, an alkylthio group, an arylthio group, an alkylsulfonyl group, an arylsulfonyl group, a carboxyl group or a sulfo group, said method comprising the step of processing the silver halide photographic material with a developing solution containing a dihydroxybenzene to form a negative image.

9. The method for developing a silver halide photographic material as in claim 8, wherein said at least one silver halide emulsion layer has a silver chloride content of at least 50% mol.

10. The method for developing a silver halide photographic material as in claim 8, wherein said at least one silver halide emulsion layer or said at least one hydrophilic colloid layer contains a redox compound which releases a restrainer by oxidation.

* * * * *